US009805583B2

(12) United States Patent
Dey et al.

(10) Patent No.: US 9,805,583 B2
(45) **Date of Patent: *Oct. 31, 2017**

(54) SENSOR BYPASS

(71) Applicant: Google Inc., Mountain View, CA (US)

(72) Inventors: Sourav Raj Dey, South San Francisco, CA (US); Mark Rajan Malhotra, San Mateo, CA (US); Yash Modi, San Mateo, CA (US); Kristoffer John Donhowe, Mountain View, CA (US)

(73) Assignee: Google Inc., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/430,754

(22) Filed: Feb. 13, 2017

(65) Prior Publication Data

US 2017/0221343 A1 Aug. 3, 2017

Related U.S. Application Data

(63) Continuation of application No. 15/008,877, filed on Jan. 28, 2016, now Pat. No. 9,589,446.

(51) Int. Cl.
*G08B 13/08* (2006.01)
*G08B 25/00* (2006.01)

(52) U.S. Cl.
CPC ..... *G08B 25/008* (2013.01); *G08B 13/08* (2013.01)

(58) Field of Classification Search
CPC ..... G06F 1/00; H04L 1/00
See application file for complete search history.

(56) References Cited

U.S. PATENT DOCUMENTS

| | | | | |
|---|---|---|---|---|
| 6,057,764 | A | 5/2000 | Williams | |
| 7,714,718 | B2 | 5/2010 | DiPoala et al. | |
| 7,916,018 | B2 | 3/2011 | Eskildsen et al. | |
| 2007/0085067 | A1* | 4/2007 | Lewis | E01F 13/065 256/73 |
| 2013/0257611 | A1* | 10/2013 | Lamb | G08B 25/008 340/501 |
| 2016/0376818 | A1* | 12/2016 | Lazarini | E05B 81/54 701/36 |

OTHER PUBLICATIONS

"Ecolink Honeywell Door/Window Sensor with local bypass", http:l/www.homecontrols.com!Ecolink-Honeywell-Compatible-Wireless-Door-Window-Sensor-ECWST212, visited Jan. 22, 2016, 7 pp.

* cited by examiner

*Primary Examiner* — Shirley Lu
(74) *Attorney, Agent, or Firm* — Morris & Kamlay LLP

(57) ABSTRACT

Systems and techniques are provided for sensor bypass. Activation may be received at a bypass input of an entry point sensor of a security system while the entry point sensor is in an armed mode. The entry point sensor may detect that the entry point monitored by the entry point sensor is closed. The entry point sensor may enter into a bypass mode. Detection by the entry point sensor of an opening of the entry point while the entry point sensor is in the bypass mode may not result in the generation of an alarm by the security system.

20 Claims, 12 Drawing Sheets

SENSOR BYPASS

BACKGROUND

Sensors may be used to monitor entry points, such as doors and windows. The sensors may provide an indication of whether an entry point is open or closed to a security system. The status of the entry point reported by the sensor may be used when determining whether an alarm should generated by the security system. For example, a security system in an armed state that receives a signal from a sensor indicating that an entry point has been opened may generate an alarm, as the opening of the entry point may indicate an attempted intrusion.

Security systems in armed states may arm all available entry point sensors, so that the opening or disturbance of any entry point monitored by a sensor may cause an alarm. To open an entry point monitored by a sensor, the security system may need to be disarmed. This may require access to a central control or hub for the security system, which may have an input device, such as a keypad, that may be used to disarm the security system. The central control may also be used to temporarily disarm a sensor at a specific entry point through appropriate input to the input device of the central control. After being disarmed, the security system or specifically disarmed sensor may need to be rearmed at the central control.

BRIEF SUMMARY

According to an implementation of the disclosed subject matter, activation may be received at a bypass input of an entry point sensor of a security system while the entry point sensor is in an armed mode. The entry point sensor may detect that the entry point monitored by the entry point sensor is closed. The entry point sensor may enter into a bypass mode. Detection by the entry point sensor of an opening of the entry point while the entry point sensor is in the bypass mode does not result in the generation of an alarm by the security system.

The entry point sensor may detect an an opening of the entry point after entering bypass mode. The entry point sensor may generate a trip signal based on the detected opening of the entry point. The entry point sensor may send the trip signal and a bypass status indicating that the entry point sensor is in the bypass mode to a hub computing device for the security system. After entering the bypass mode, the entry point sensor may determine that a first timeout period has elapsed before the entry point sensor detects an opening of the entry point or receives a subsequent activation of the bypass input. The entry point sensor may exit the bypass mode. The entry point sensor may reenter the armed mode.

After entering, by the entry point sensor, the bypass mode, subsequent activation of the bypass input may be received at the entry point sensor before a first timeout period has elapsed and before the entry point sensor detects an opening of the entry point. The entry point sensor may exit the bypass mode. The entry point sensor may reenter the armed mode.

After detecting, by the entry point sensor, an opening of the entry point, either the entry points sensor may determine that a second timeout period has elapsed before the entry point sensor detects a closing of the entry point and before the entry point sensor receives a subsequent activation of the bypass input or at the subsequent activation of the bypass input may be received at the entry point sensor before the second timeout period has elapsed and before the entry point sensor detects a closing of the entry point. The entry point sensor may exit the bypass mode. The entry point sensor may reenter the armed mode.

After detecting, by the entry point sensor, an opening of the entry point, the entry point sensor may detect a closing of the entry point before a second timeout period has elapsed and before the entry point sensor receives a subsequent activation of the bypass input. The entry point sensor may exit the bypass mode. The entry point sensor may reenter the armed mode.

After reentering, by the entry point sensor, the armed mode, a subsequent activation of the bypass input may be received at the entry point sensor before detecting a closing of the entry point. The entry point sensor may remain in the armed mode. The entry points sensor may a report of the activation of the bypass input to the hub computing device of the security system.

After reentering, by the entry point sensor, the armed mode, the entry point sensor may detect a closing of the entry point. The entry point sensor may receive a subsequent activation of the bypass input while the entry point is closed. The entry point sensor may enter into the bypass mode.

After entering the bypass mode, the entry point sensor may detect an opening of the entry point. The entry point sensor may not generate a trip signal based on the detected opening of the entry point, wherein a trip signal would have been generated based on detecting the opening of the entry point when the entry point sensor was in the armed mode.

The bypass input may be a hardware input of the entry point sensor. The bypass input may be physically accessible only to a person on the same side of the entry point as the entry point sensor when the entry point is closed. An indicator device of the entry point sensor may output an indication that the entry point sensor is in bypass mode.

According to an embodiment of the disclosed subject matter, a means for receiving, at an entry point sensor of a security system, activation at a bypass input while the entry point sensor is in an armed mode, a means for detecting, by the entry point sensor, that the entry point monitored by the entry point sensor is closed, a means for entering, by the entry point sensor, into a bypass mode, wherein detection by the entry point sensor of an opening of the entry point while the entry point sensor is in the bypass mode does not result in the generation of an alarm by the security system, a means for after entering the bypass mode, detecting, by the entry point sensor, an opening of the entry point, a means for generating, by the entry point sensor, a trip signal based on the detected opening of the entry point, a means for sending, by the entry point sensor, the trip signal and a bypass status indicating that the entry point sensor is in the bypass mode to a hub computing device for the security system, a means for after entering the bypass mode, determining by the entry point sensor that a first timeout period has elapsed before the entry point sensor detects an opening of the entry point or receives a subsequent activation of the bypass input, a means for exiting, by the entry point sensor, the bypass mode, a means for reentering, by the entry point sensor, the armed mode, a means for after entering the bypass mode, receiving at the entry point sensor a subsequent activation of the bypass input before a first timeout period has elapsed and before the entry point sensor detects an opening of the entry point, a means for exiting, by the entry point sensor, the bypass mode, a means for reentering, by the entry point sensor, the armed mode, a means for after detecting, by the entry point sensor, an opening of the entry point, either determining by the entry point sensor that a second timeout period has elapsed before the entry point sensor detects a closing of the entry point and before the entry point sensor receives a subsequent activation of the bypass input or receiving at the entry point sensor the subsequent activation of the bypass input before the second timeout period has elapsed and before the entry point sensor detects a closing of the entry point, a means for exiting, by the entry point sensor, the bypass mode, a means for reentering, by the entry point sensor, the armed mode, a means for after detecting, by the entry point sensor, an opening of the entry point, detecting, by the entry point sensor, a closing of the entry point before a second timeout period has elapsed and before the entry point sensor receives a subsequent activation of the bypass input, a means for exiting, by the entry point sensor, the bypass mode, a means for reentering, by the entry point sensor, the armed mode, a means for after reentering, by the entry point sensor, the armed mode, receiving at the entry point sensor a subsequent activation of the bypass input before detecting a closing of the entry point, a means for remaining, by the entry point sensor, in the armed mode, a means for sending, by the entry point sensor, a report of the activation of the bypass input to the hub computing device of the security system, a means for after reentering, by the entry point sensor, the armed mode, detecting by the entry point sensor a closing of the entry point, a means for receiving, by the entry point sensor, a subsequent activation of the bypass input while the entry point is closed, a means for entering, by the entry point sensor, into the bypass mode, a means for after entering the bypass mode, detecting, by the entry point sensor, an opening of the entry point, a means for not generating, by the entry point sensor, a trip signal based on the detected opening of the entry point, wherein a trip signal would have been generated based on detecting the opening of the entry point when the entry point sensor was in the armed mode, and a means for outputting, by an indicator device of the entry point sensor, an indication that the entry point sensor is in bypass mode, are included.

Additional features, advantages, and implementations of the disclosed subject matter may be set forth or apparent from consideration of the following detailed description, drawings, and claims. Moreover, it is to be understood that both the foregoing summary and the following detailed description provide examples of implementations and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
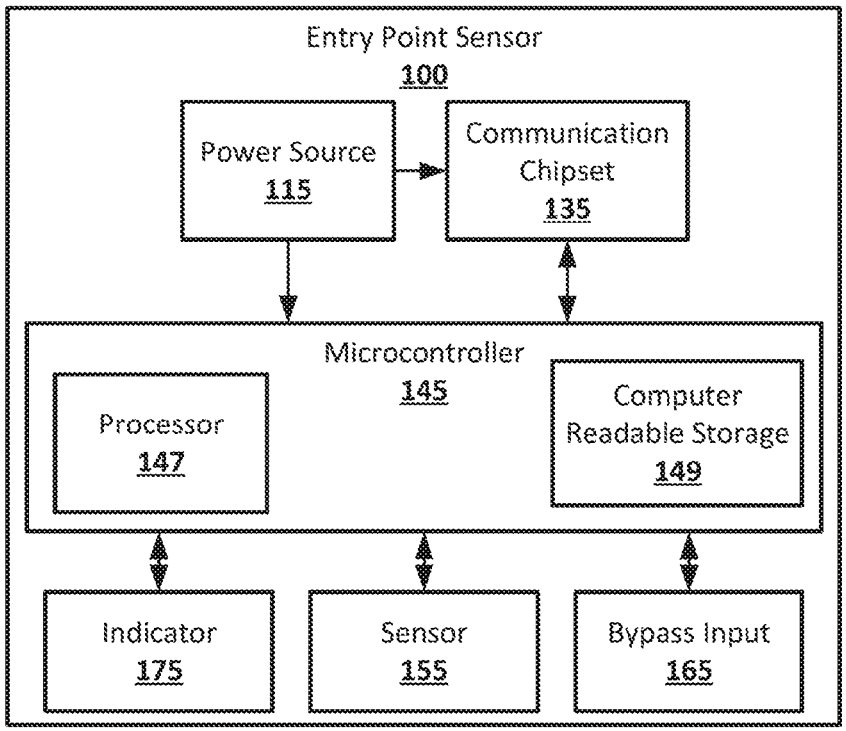
FIG. 1 shows an example system suitable for sensor bypass according to an implementation of the disclosed subject matter.

According to embodiments disclosed herein, an entry point sensor may include a bypass input that may allow for the temporary disarming of the entry point sensor. Entry point sensors may be used to monitor entry points, such as the doors and windows of a house. An entry point sensor may be installed on or in the vicinity of an entry point, and may be connected to a security system. The entry point sensor may include a bypass input, which may be, for example, a hardware button on the entry point sensor. The entry point sensor and bypass input may be located so that the bypass input may only be accessible to a person on a particular side of the entry point. For example, the bypass input on an entry point sensor monitoring a door to a house may only be accessible to someone on the inside of the house. When the bypass input is activated, the entry point sensor may be temporarily disarmed without disarming the rest of the security system, including other entry point sensors on other entry points. The entry point may be opened without generating an alarm. After some period of time, or after the entry point is closed, the temporarily disarmed entry point sensor may be rearmed.

An entry point sensor may be any suitable type of sensor for detecting the opening, closing, or disturbance of an entry point. For example, an entry point sensor may include any suitable combination of a magnet and magnetometer, either housed together or as separate physical devices, an accelerometer, a gyroscope, a motion detector of any suitable type, including, for example, an infrared or other light source motion detector and source housed separately or together with a separate reflector, an infrared or other optical tripwire, and a camera. An entry point sensor may monitor a particular entry point, such as a door or window. The entry point sensor for an entry point may be installed directly on the entry point, or in the vicinity of the entry point. For example, an entry point sensor with a magnet and magnetometer may be installed on a door with the magnet affixed to the door frame and the magnetometer affixed to the door, such that movement of the door may result in the magnetometer detecting a change in the total magnetic field at the location of the magnetometer.

Entry point sensors throughout an environment, such as a house, may be connected to a security system. A security system may include a hub computing device, which may be any suitable computing device for managing a security system, and may also manage an automation system including other functions beyond security. The hub computing device may be a controller for a smart home environment. For example, the hub computing device may be or include a smart thermostat. The hub computing device may also be another device within the smart home environment, or may be a separate computing device dedicated to managing the smart home environment. The hub computing device may be connected, through any suitable wired and wireless connections, to a number of sensors distributed throughout an environment. Some of the sensors may be entry point sensors, which may monitor the entry points, such as the doors and windows, of the environment. When an entry point sensor is armed and detects that an entry point has been opened or disturbed, the entry point sensor may trip, and may generate a trip signal. A trip signal from an entry point sensor may indicate that an opening event has been detected at the entry point monitored by the entry point sensor. The hub computing device may receive the signal indicating the trip, and depending on the mode of the security system, may sound an alarm or otherwise generate an alert or notification to a user of the home security system or other appropriate party, such as a security service, indicating that the entry point is open. The entry point sensor may directly signal that it has been tripped, or the tripping of the entry point sensor may be interpreted by the hub computing device based on a status signal from the sensor. For example, a magnetic contact sensor may send a signal indicating whether it is open or closed, and the hub computing device may interpret an open signal as a tripping of the magnetic contact sensor when the magnetic contact sensor is armed. Alternatively, the magnetic contact sensor may be able to send a separate signal, apart from an open or closed signal, indicating that it has been tripped.

The mode of the security system may determine how the security system responds to a trip signal from an entry point sensor. For example, when the security system is in an armed mode which includes an arming of the entry point sensor that generated the trip signal, the security system may respond to a trip signal by sounding an alarm or otherwise generating an alert or notification to a user of the home security system or other appropriate party, such as a security service, indicating that the entry point is open. When the security system is in an armed mode which does not include arming of the entry point sensor that generated the trip signal, or is in a disarmed mode, the security system may take no action in response to a trip signal from an entry point sensor.

An entry point sensor may include a bypass input. The bypass input may be any suitable input device for providing input to the entry point sensor based on physical proximity and access to the entry point sensor. For example, the bypass input may be a hardware button of any suitable type, such as a click button which may include a spring, a switch, or a touchpad or touchscreen control which may only be usable by a person who can physically reach the entry point sensor. The bypass input may be activated through proximity, touch, heat, motion, reflected light, conductivity, or in any other suitable manner. The bypass input may be connected to electronics within the entry point in sensor in any suitable manner, such that activation of the bypass input may cause a signal to be sent to a processor of the entry point sensor. The bypass input may be separate from the entry point sensor, and may be connected to the entry point sensor in any suitable manner, including through wired or wireless connections. For example, a bypass sensor may be connected to an entry point sensor through a direct wireless connection, or through a wireless network through, for example, the hub computing device.

The bypass input may be used to place the entry point sensor into bypass mode and to take the entry point sensor out of bypass mode. For example, the bypass input may be a button on an entry point sensor that, when pushed, causes the entry point sensor to enter bypass mode. In bypass mode, the entry point monitored by the entry point sensor may be opened without causing the security system, in an armed mode, to sound an alarm or otherwise generate an alert or notification to a user of the home security system or other appropriate party, such as a security service, indicating that the entry point is open. The security system may not respond to a trip signal from an entry point sensor that has been placed in bypass mode using the bypass input.

An entry point sensor may only be placed in bypass mode if the security system is in the proper armed mode. Activation of the bypass input on an entry point sensor may not cause the entry point sensor to enter bypass mode if, for example, the security system is in a disarmed mode, or is in an armed mode that indicates that no one should be present to use the bypass input. For example, the security system may be in away/armed mode, which may indicate that the security system, and the entry point sensor, are armed, and that the environment should have no occupants. For example, a family on vacation may have the security system for their house set to an away/armed mode. Because the bypass input may be located so that only an occupant of an environment, for example, a person on the inside of a house, can access and activate the bypass input, any attempted activation of a bypass input when the environment is supposed to have no occupants may not cause the entry point sensor to enter bypass mode, and may be reported to the hub computing device as an indication of potential intrusion. The bypass input may be usable when, for example, the security system is in home/armed mode, or stay mode, which may indicate that the security system, and entry point sensor, are armed, and that occupants are expected to be in the environment. For example, a family in their house at night may have the security system for the house set to a home/armed mode, or stay mode. Activation of the bypass input may also not result in the entry point sensor entering bypass mode, and may result in reporting of the activation, if the entry point monitored by the entry point sensor is already opened.

After being placed in bypass mode through activation of the bypass input, the entry point sensor may monitor for either an opening of the entry point, a second activation of the bypass input, or the elapsing of a timeout period. The timeout period may be any suitable length, such as, for example, 60 seconds. The entry point sensor may exit bypass mode, rearming the entry point sensor, once the timeout period has elapsed after activation of the bypass input causes the entry point sensor to enter bypass mode if either an opening of the entry point or a second activation of the bypass input is not detected within the timeout period. The entry point sensor may also exit bypass mode when a second activation of the bypass input is detected before the timeout period elapses and before the entry point is detected as being open.

When an opening of the entry point is detected within the timeout period after entering bypass mode, the entry point sensor may either not send a trip signal to the hub computing device of the security system, or may send a trip signal that may indicate both that an opening event of the entry point was detected, and that the entry point sensor was in bypass mode when the opening event occurred. This may prevent the security system from sounding an alarm or otherwise generating an alert or notification to a user of the home security system or other appropriate party, such as a security service, indicating that the entry point is open, even though the security system may be in an armed mode. The security system may either not receive the trip signal, due to the entry point sensor not sending the trip signal, or may receive the trip signal along with the indication the entry point sensor was in bypass mode, resulting in the security system taking no action. All other entry point sensors may remained armed, and the security system may respond normally to any trip signal received from any other entry point sensor that has not been put into bypass mode.

After detecting an opening of the entry point before the timeout period has elapsed, the entry point sensor may monitor for a closing of the entry point, a second activation of the bypass input, or the elapsing of a second timeout period. The second timeout period may be any suitable length, such as, for example, 180 seconds. The entry point sensor may exit bypass mode, rearming the entry point sensor, once the second timeout period has elapsed after detection of an opening of the entry point if either a closing of the entry point or a second activation of the bypass input is not detected within the timeout period. The entry point sensor may also exit bypass mode when a second activation of the bypass input is detected, or when a closing of the entry point is detected.

If the second timeout period elapses, or a second activation of the bypass input is detected, the entry point sensor may exit bypass mode and be rearmed while the entry point remains open. The entry point sensor may generate a trip signal based on a detected further opening of the entry point. This may allow, for example, a window to be left slightly open without resulting in an alarm, with any further attempted opening of the window resulting in an alarm. An entry point sensor that exits bypass mode and rearms while the monitored entry point is still open may not enter bypass mode again due to any further activation of the bypass input until the entry point is detected as being closed. This may prevent, for example, a person outside of a house reaching through a cracked window and activating the bypass input so that they can further open the window without generating an alarm from the security system. Activation of the bypass input of an entry point sensor that has exited bypass mode while the entry point is still opened may be reported to the hub computing device as a potential indicator of intrusion. The degree to which an entry point may be opened while still allowing the entry point sensor to rearm without also causing the security system to generate an alarm may be limited, and may depend on the type of entry point sensor in use. For example, an entry point sensor which is able to detect and distinguish the full range of opening and closing of an entry point may be able to rearm without resulting in an alarm after being placed into bypass mode when the entry point is halfway open, while a less sensitive entry point sensor may only be able to rearm without an alarm when the entry point is slightly ajar. The degree to which an entry point may be opened while allowing the entry point sensor to rearm without resulting an alarm may be limited, for example, for security purposes. For example, an entry point sensor which was placed into bypass mode to allow a person to open a door may generate a trip signal resulting in an alarm upon exiting bypass mode and rearming if the door remains far enough open that a person could enter without opening the door any further. An entry point sensor which exits bypass mode while an entry point is opened too far may generate a trip signal with an indicator that the entry point was left open too far. The hub computing device may take any appropriate action based on receiving this trip signal and indicator, including, for example, generating an alarm from the security system, entering a pre-alarm start, or generating a notification that may indicate to an occupant of the environment that an entry point is opened. In some implementations, the entry point sensor may use readings from an accelerometer on the entry point to determine whether to exit bypass mode while the entry point is open. The accelerometer may be part of the entry point sensor. The entry point sensor may exit bypass mode and be rearmed when the accelerometer indicates that the entry point has stopped moving after the initial activation of the bypass input followed by movement of the entry point. The cessation of movement may indicate that the entry point has been opened as far as the person opening the entry point desires. The entry point sensor may exit bypass mode and be rearmed if the entry point is not so far open that further opening of the entry point cannot be detected. The entry point sensor may also exit bypass mode based on, for example, an instruction received from the hub computing device, which may be sent out in response to an instructions from an input device for the hub computing device. For example, a user may use a keypad or touchscreen of the hub computing device, or an application on a mobile computing device that communicates with the hub computing device, to indicate that the entry point sensor should exit bypass mode. This may allow the entry sensor to exit bypass mode and be rearmed based on instructions issued remotely.

The bypass input may allow, for example, a person on the inside of a house to open a window or door that is monitored by an entry point sensor without disarming the security system and without triggering an alarm. The window or door may be opened temporarily before the entry point sensor monitoring the window or door is rearmed, preventing the window or door from being unprotected for a long period of time due to use of the bypass input without requiring that the person who used the bypass input remember to rearm the entry point sensor. The entry point sensor may be rearmed once the door is window is closed. The entry point sensor may also rearm with a door or window left open a certain amount after the expiration of the second timeout period, such that any further opening of the window or door may trip the entry point sensor, and any subsequent activation of the bypass input before the window or door is closed may be reported to as an indicator of potential intrusion, which the security system may use to generate an alarm The manner in which use of the bypass input affects the entry point sensor may be configurable by a user. For example, a user may set the timeout periods after which the entry point sensor will rearm when the bypass input is activated. Multiple activations of the bypass input within a short period of time may be configured to change the operation of the entry point sensor. For example, two activations of the bypass input in quick succession may result in the entry point sensor not being able to reenter the armed mode while the entry point is open. Instead, the entry point sensor may trip and generate an alarm if the entry point is not closed within some timeout period. Two activations of the bypass input in quick succession after the bypass input has been activated and the entry point has been opened may extend the timeout period before the entry point sensor exits bypass mode and rearms.

The entry point sensor may include an indicator device. The indicator device may be, for example, an LED, an array of LEDS, a display screen, or any suitable device for providing feedback to a person who can view the entry point sensor. For example, the entry point sensor may include one or more LEDs that may provide various indicators, such as red, green, and/or yellow light, which may be displayed as solid or blinking. The LED may be located on the body of the entry point sensor such that it may be visible to a person who is able to access and activate the bypass input. The indicator device may be used to indicate when the entry point sensor is armed, when the entry point sensor has entered bypass mode, and when the entry point sensor is existing bypass mode and rearming. For example, an LED may solidly display or blink a particular color, such as red, when the entry point sensor is armed, may solidly display or blink a particular color, such as yellow, when the entry point sensor is in bypass mode, and may rapidly blink a particular color, for example, red, upon exiting bypass mode before displaying the indication for armed mode. In some implementations, the indicator device may not be active when the entry point sensor is in armed mode, for example, an LED may be turned off, to reduce power consumption by the entry point sensor.

If an occupant opens an entry point monitored by an entry point sensor with a bypass input while the entry point sensor is armed and without using the bypass input to cause the entry point sensor to enter bypass mode, a trip signal may be generated. The trip signal may be received by the hub computing device, which may generate an alarm. The occupant may disarm the security system, including the entry point sensor, within a short time period in order to silence the alarm. For example, the occupant may access an input device to the hub computing device, or use a mobile computing device such as a smartphone or tablet that is connected to the hub computing device, to input a PIN, password, or other form of credential that may disarm the security system and silence the alarm. The hub computing device may display to the occupant, for example, on a display of the hub computing device or at a mobile computing device used by the occupant, information regarding the use of the bypass input on the entry point sensor. The information may be displayed in any suitable form, including text, audio, video, or hyperlinks to such text, audio, or video. This may increase the likelihood that the occupant will use the bypass input on an entry point sensor that is armed before the occupant opens the entry point, reducing the generation of alarms by the occupant and the need for the occupant to disarm the security system to silence such alarms.

In some implementations, the hub computing device may change the state of other sensors in the environment when it receives a trip signal that indicates an opening event was detected by a sensor in bypass mode. For example, the hub computing device may disarm motion sensors in the vicinity of the entry point sensor from which the trip signal was received to prevent an alarm from being generated based on detected motion near the entry point that was opened. The effect the use of the bypass input on an entry point sensor has on other sensors in the environment may be configurable by a user. For example, a user of the hub computing device may configure the bypass input of a door's entry point sensor to temporarily disarm motion sensors on the other side of the door from the entry point sensor. This may allow for the use of the bypass input on the entry point sensor on the door to allow a person to open and go through the door and into an adjoining room without resulting in an alarm and without disarming other entry point sensors or motion sensors in the environment.

In some implementations, the entry point sensor may send sensor data to the hub computing device, which may analyze the data to determine if the entry point monitored by the opening sensor has been opened. Trip signals may be generated on behalf of the entry point sensor by the hub computing device based on analysis of the data from the entry point sensor. For example, a magnetometer may send raw magnetic field data to the hub computing device, which may analyze the magnetic field data, and changes in the magnetic field data over time, to determine whether the entry point has been opened to generate a trip signal on behalf of the entry point sensor.

In some implementations, the hub computing device may track the bypass status of an entry point sensor, and may determine when an entry point sensor should enter or exit bypass mode. For example, an entry point sensor may report any activation of its bypass input to the hub computing device, which may be determine, based on the mode of the security system and the status of the entry point sensor and entry point monitored by the entry point sensor, whether the entry point sensor should enter, exit, or remain in bypass mode or armed mode. The bypass status of an entry point sensor may be maintained on the hub computing device, and the entry point sensor may not need to store or be aware of its own bypass status. The entry point sensor may report any trips signals, and the hub computing device may determine whether to generate an alarm based on the bypass status of the entry point sensor, as maintained at the hub computing device. The hub computing device may also track timeout periods for entry point sensors, for example tracking the first timeout period after determining that the entry point sensor should enter bypass ode and the second timeout period after determining that the entry point was opened after entering bypass mode. The hub computing device may determine when a closing of an entry point should cause an entry point sensor to exit bypass mode. The hub computing device may also control any indicator device of the hub computing device based on the bypass status of the entry point sensor as maintained at the hub computing device.

FIG. 1 shows an example system suitable for sensor bypass according to an implementation of the disclosed subject matter. An entry point sensor 100 may include a microcontroller 145 for a sensor 155, a power source 115, a transceiver (e.g., using radio or another communications medium) represented by the communication chipset 135, a bypass input 165, and an indicator 175. The communication chipset may refer to hardware suitable for wired and/or wireless communications such as a Wifi, Thread, Ethernet, mesh network, or similar network connection. The microcontroller 145 may include a processor 147, a computer readable storage 149 that may be programmed with computer readable code. The microcontroller 145 may receive instructions (which may include configuration information and activation signals) from a controller, for example, controller 73 as described in FIG. 12, and/or a remote system such, for example, remote system 74 as described in FIG. 12. Similarly, the microcontroller 145 may communicate data generated by the sensor 155 to the controller 73, for example, a hub computing device, and/or the remote system 74 via the communication chipset 135. The entry point sensor 100 may receive power from any suitable power source 115, such as, for example, a lithium battery, an electrical outlet, or a wireless power supply.

The sensor 155 may be any suitable device for detecting characteristics of an entry point, including characteristics related to the opening, closing, or disturbance of an entry point. For example, the sensor 155 may be a magnetometer that may be housed together with or separately from a magnet, an accelerometer, a gyroscope, a motion detector of any suitable type, including, for example, an passive or active infrared or other light source motion detectors and sources housed separately or together with a separate reflector, an infrared or other optical tripwire, or a camera. The entry point sensor 100 may include more than one type of sensor 155. The sensor 155 may be connected to the microcontroller 145, and may transmit signals including any data detected by the sensor 155 in any suitable format, including, for example, magnetic field strengths, accelerometer and gyroscope readings, motion detector data, and video data. Data sent to the microcontroller 145 may be raw, and interpreted by the processor 147, or may be pre-interpreted by the sensor 155. For example, the sensor 155 may be a magnetometer which may determine itself when an entry point has been opened based on changes in a detected magnetic field, or may report raw magnetic field data to the processor 147 which may determine whether the data indicates an opening of the entry point.

The bypass input 165 may be any suitable hardware input device of the entry point sensor 100. The bypass input 165 may be, for example, a button, switch, touchpad, or touchscreen accessible on the housing of the entry point sensor 100. The bypass input 165 may be positioned so that it may be accessible to a person who can physically access the entry point sensor 100 when the entry point monitored by the entry point sensor 100 is closed. The bypass input 165 may be activated in any suitable manner. For example, a button may be depressed, a switch may be flipped, or touchpads and touchscreens may be tapped or swiped. The bypass input 165 may be connected to the microcontroller 145. When the bypass input 165 is activated, the bypass input 165 may send any suitable signal to the microcontroller 145 to indicate the activation to the processor 147.

The indicator 175 may be any suitable device for indicating the status of the entry point sensor 100 to a person who is in proximity to the entry point sensor 100. For example, the indicator 175 may be an LED, an array of LEDS, a display screen, or other device for providing a visual indication of the status of the entry point sensor 100. For example, the indicator 175 may be a ring illuminated by any number of LEDs around a circular bypass input 165. In some implementations, the entry point sensor 100 may provide auditory or tactile indications of the stats of the entry point sensor 100, along with or in place of visual indicators. The indicator 175 may be connected to, and controlled by, the microcontroller 145. The indicator 175 may be controlled to visually indicate when the entry point sensor 100 is in armed mode, a disarmed mode, or a bypass mode, and may also provide indications when the entry point sensor 100 changes between modes. For example, the indicator 175 may be an LED which may display, or blink at a specified rate, a first color when the entry point sensor 100 is in an armed mode, a second color when the entry point sensor 100 is in a disarmed mode, a third color when the entry point is in a bypass mode, and may display, or blink, a specified color for a specified period of time when the entry point sensor 100 changes between modes. In some implementations, the indicator 175 may only provide an active indication when the entry point sensor 100 is in certain modes and may be inactive for other modes. For example, an LED may display a solid color when the entry point sensor 100 is in bypass mode, but may be off when the entry point sensor 100 is in armed mode or is in a disarmed mode that is not the result of being in bypass mode.

Figure 2:
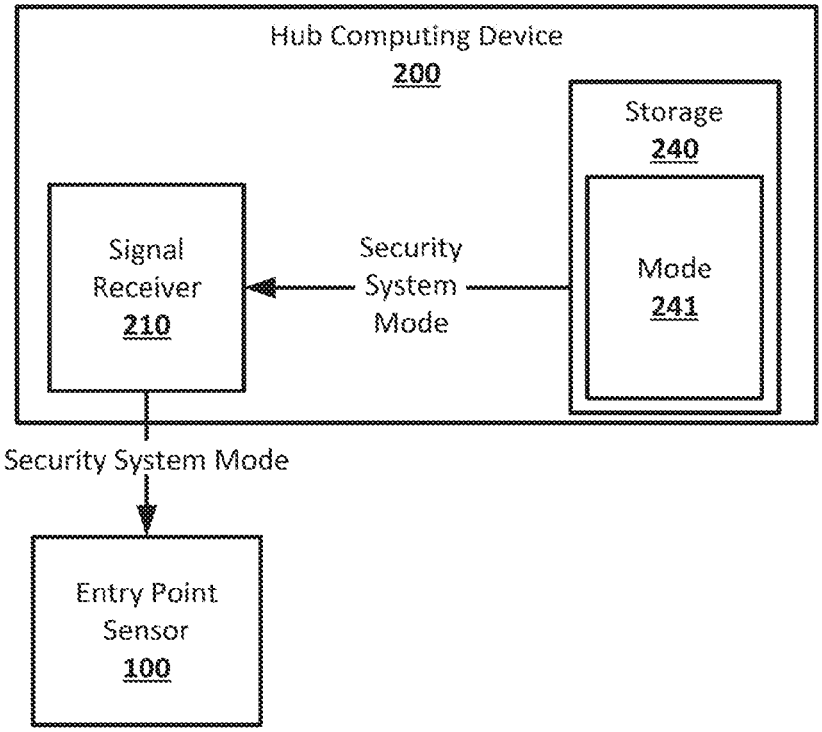
FIG. 2 shows an example arrangement suitable for sensor bypass according to an implementation of the disclosed subject matter.

FIG. 2 shows an example arrangement suitable for sensor bypass according to an implementation of the disclosed subject matter. A hub computing device 200 may include a signal receiver 210. The hub computing device 200 may be any suitable device, such as, for example, a computer 20 as described in FIG. 14, for implementing the signal receiver 210 and the storage 240. The hub computing device 200 may be, for example, a controller 73 as described in FIG. 12. The hub computing device 200 may be a single computing device, or may include multiple connected computing devices, and may be, for example, a smart thermostat, other smart sensor, smartphone, tablet, laptop, desktop, smart television, smart watch, or other computing device that may be able to act as a hub for a smart home environment, which may include a security system and automation functions. The smart home environment may be controlled from the hub computing device 200. The hub computing device 200 may also include a display. The signal receiver 210 may be any suitable combination of hardware or software for receiving signals generated by sensors that may be part of the smart home environment and may be connected to the hub computing device 200.

The hub computing device 200 may be any suitable computing device for acting as the hub of a smart home environment. For example, the hub computing device 200 may be a smart thermostat, which may be connected to various sensors throughout an environment as well as to various systems within the environment, such as HVAC systems, or it may be another device within the smart home environment. The hub computing device 200 may include any suitable hardware and software interfaces through which a user may interact with the hub computing device 200. For example, the hub computing device 200 may include a touchscreen display, or may include web-based or app based interface that can be accessed using another computing device, such as a smartphone, tablet, or laptop. The hub computing device 200 may be located within the same environment as the smart home environment it controls, or may be located offsite. An onsite hub computing device 200 may use computation resources from other computing devices throughout the environment or connected remotely, such as, for example, as part of a cloud computing platform.

The hub computing device 200 may include a signal receiver 210. The signal receiver 210 may be any suitable combination of hardware and software for receiving signals from sensors connected to the hub computing device 200. For example, the signal receiver 210 may receive signals from any sensors distributed throughout a smart home environment, either individually or as part of sensor devices. The signal receiver 210 may receive any suitable signals from the sensors, including, for example, audio and video signals, signals indicating light levels, signals indicating detection or non-detection of motion, signals indicating whether entry points are open, closed, opening, closing, or experiencing any other form of displacement or tampering, signals indicating the current climate conditions within and outside of the environment, smoke and carbon monoxide detection signals, and signals indicating the presence or absence of occupants in the environment based on Bluetooth or WiFi signals and connections from electronic devices associated with occupants or fobs carried by occupants. The signal receiver 210 may pass received signals to other components of the hub computing device 220 for further processing, such as, for example, detection of tripped opening sensors. The signal receiver 210 may also be able to receive, or to associate with a received signal, an identification for the sensor from which the signal was received. This may allow the signal receiver 210 to distinguish which signals are being received from which sensors throughout the smart home environment. The signal receiver 210 may filter signals based on the type of sensor that generated the signal.

The signal receiver 210, or other suitable component of hub computing device 200, may communicate with the entry point sensor 100. The entry point sensor 100 may receive a mode 241 of the security system, which may be stored in the storage 240 of the hub computing device 200. The mode 241 may indicate the current mode of the security system of the smart home environment. The mode 241 may indicate, for example, a structure state and an arm state. The structure state may indicate whether occupants of the environment are currently occupying the environment or are expected to occupy the environment within some length of time. For example, a structure state of "home" may indicate that occupants are occupying the environment, "away" may indicate that the occupants are away from the environment but are expected to return, and "vacation" may indicate that the occupants are away from the environment and are not expected to return for some length of time, for example, several days. The arm state may indicate whether the security system, and the sensors through the security system such as the entry point sensor 100, are armed. In an armed mode, sensors may be armed, and trip signals from sensors may generate alarms. In a disarmed mode, sensors may be disarmed, and trip signals from sensors may not generate alarms. The arm state may be mixed, for example, with some arm states including a mix of armed and disarmed sensors, for example, depending on the structure state. The mode 241 may be, for example, a "stay" mode, which may indicate a structure state of "home" and an armed state of "armed," which may arm sensors on all external entry points, but may disarm sensors on internal entry points, such as interior doors, and may disarm some interior motion sensors. The entry point sensor 100 may store the mode 241, as received from the hub computing device 200, in any suitable manner. For example, the entry point sensor 100 may store the mode 241 in the computer readable storage 149 of the microcontroller 145.

Figure 3A:
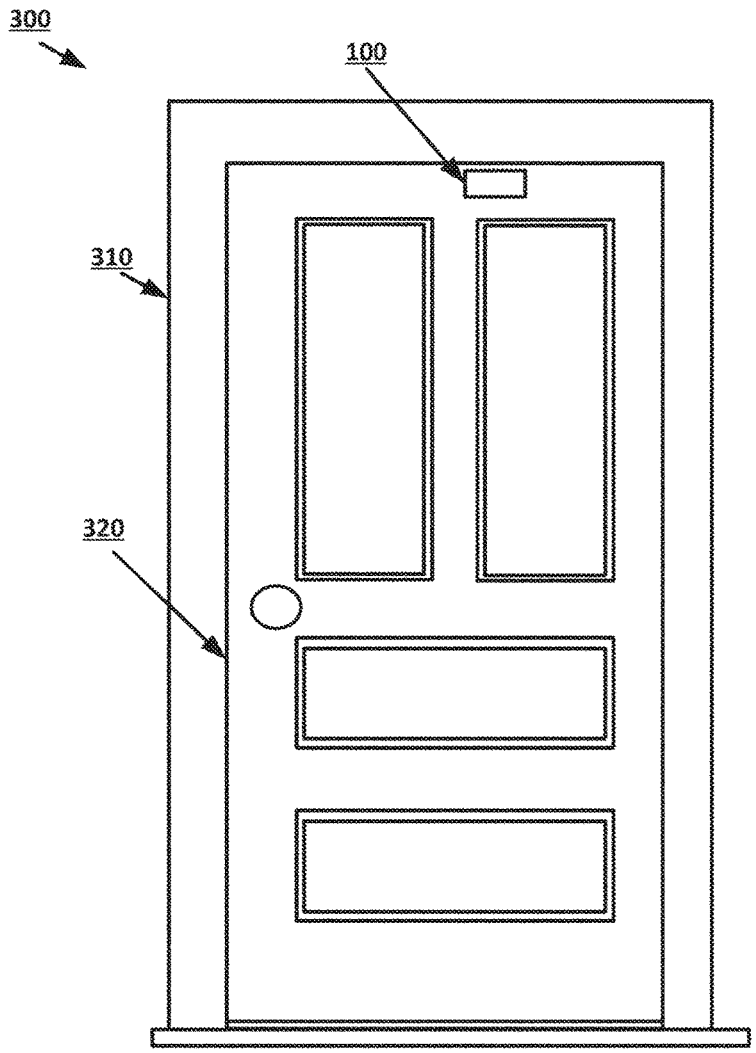
FIGS. 3A and 3B show example installations suitable for sensor bypass according to an implementation of the disclosed subject matter.
Figure 3B:
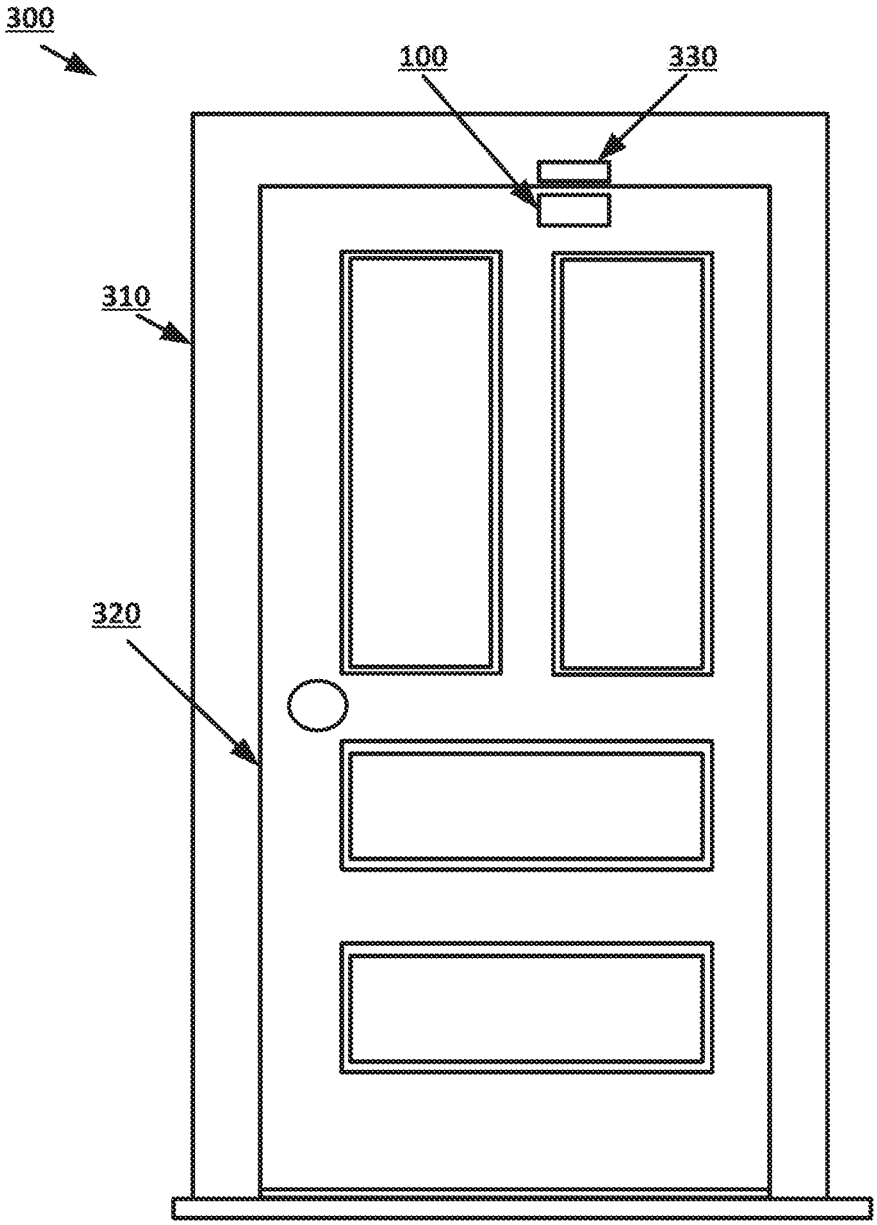

FIGS. 3A and 3B show example installations suitable for sensor bypass according to an implementation of the disclosed subject matter. As depicted in FIG. 3A, the entry point sensor 100 may be installed at an entry point 300, which may include a door 320 installed in a door frame 310. The entry point 300 may be an interior entry point, for example, between rooms in a house, or an exterior entry point, for example, between the inside of a house and an outdoor area. The entry point sensor 100 may be affixed to the inside of the door 320 in any suitable manner, such as, for example, using touch fasteners, tape, adhesive, or fastening mechanisms such as screws or bolts. The entry point sensor 100 may be affixed at any suitable point on the door 320, including, for example, at the top of the door 320, or on the door frame 310. The entry point sensor 100 may be affixed so it may monitor the status of the entry point 300. For example, the entry point sensor 100 may detect when the door 320 is opened, and may be able to determine how far open the door 320, for example, based on the distance from or angle formed with the door frame 310. The entry point sensor 100 may also detect disturbance of the entry point 300. For example, the entry point sensor 100 may be able detect an attempt to open the door 320 when the door 320 is locked, for example, based on vibrations of the door 320 and door frame 310.

As depicted in FIG. 3B, the entry point sensor 100 may include a second component 330. The second component 330 may be, for example, a magnet which may be used with a magnetometer in the entry point sensor 100, or a reflector or light source for use with a light based sensor. The second component 330 may be affixed to the door frame 310 in any suitable based on the location at which the entry point sensor 100 affixed to the door 320, and on the nature of the second component 330. For example, if the second component 330 includes a magnet and the entry point sensor 100 includes a magnetometer and is affixed to the top of the door 320, the second component 130 including the magnet may be affixed to the top of the door frame 310 at a position vertically aligned with the magnetometer of the entry point sensor 100. The entry point sensor 100 may be affixed to the door frame 310 and the second component may be affixed to the door 320. The entry point sensor 100 may be aligned vertically, horizontally, or at any suitable angle with the second component 330.

Figure 4A:
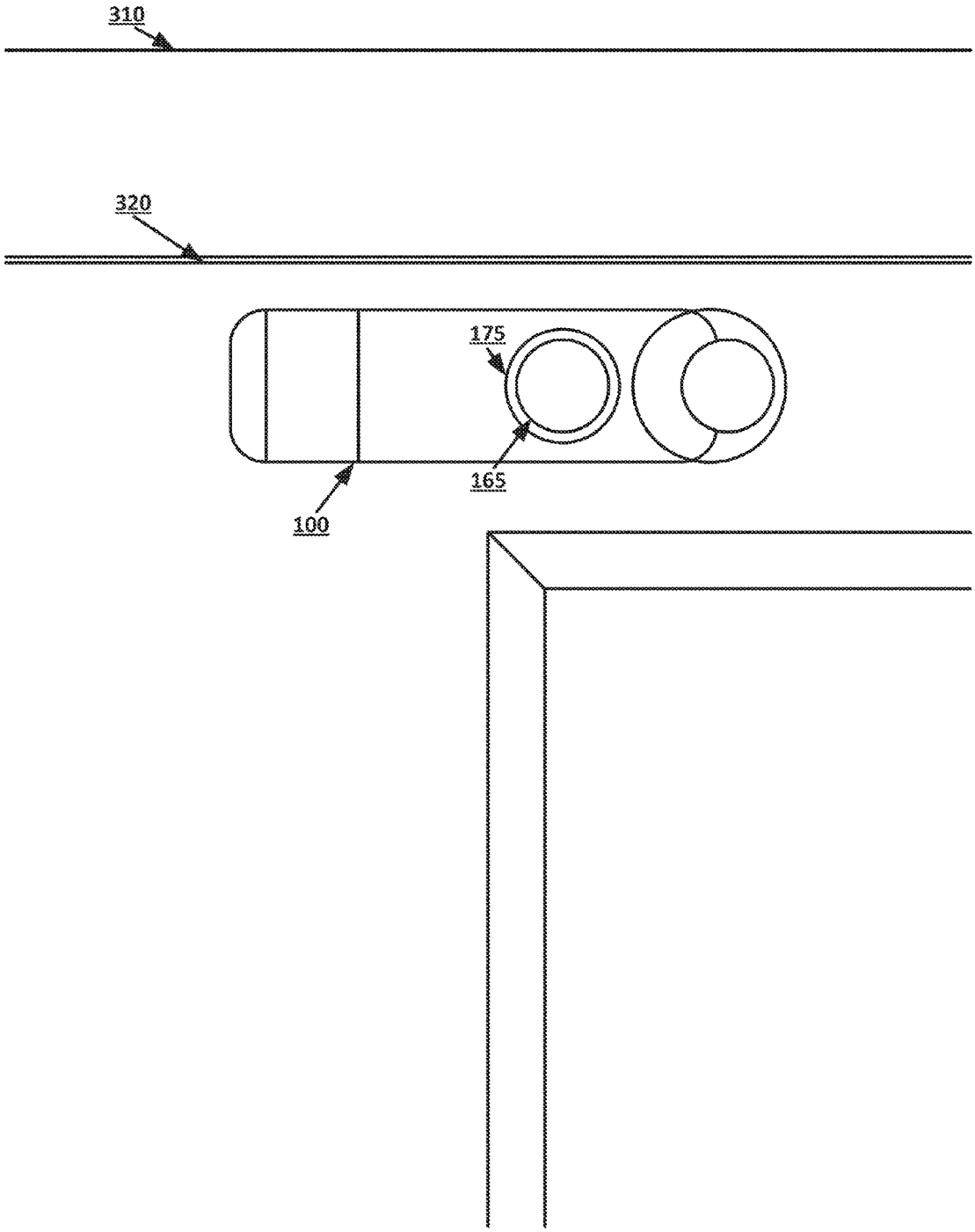
FIGS. 4A and 4B show example installations suitable for sensor bypass according to an implementation of the disclosed subject matter.
Figure 4B:
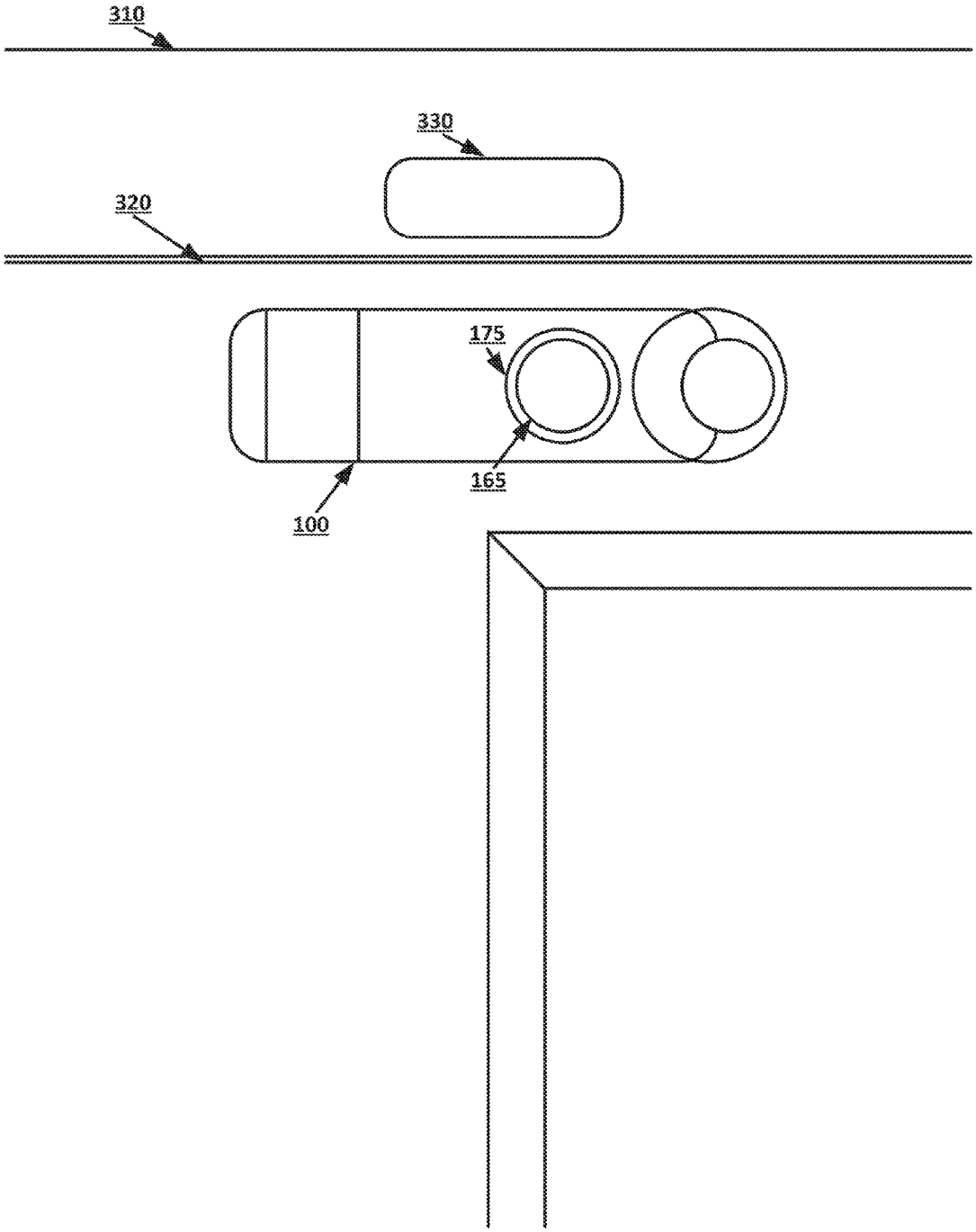

FIGS. 4A and 4B show example installations suitable for sensor bypass according to an implementation of the disclosed subject matter. As depicted in FIG. 4A, the entry point sensor 100, including indicator 175 and bypass input 165, may installed at the entry point 300 so that that indicator 175 and the bypass input 165 are visible and accessible to a person on the inside of the entry point 300. For example, the entry point sensor 100 may be installed at the top of the door 320, so that the indicator 175 and the bypass input 165 may face outwards and be visible and accessible to a person on the inside of the door 320. For example, if the door 320 is an exterior door of a house, the indicator 175 and bypass input 165 may be visible and accessible to a person inside of the house. If the door 320 is an interior door, the indicator 175 and the bypass input 165 may be accessible to a person on the inside of a room the door leads to from a hallway, or the inside of a room farther from an exterior door if the door 320 is between two rooms.

As depicted in FIG. 4A, if the entry point sensor 100 uses a second component 330, the second component 330 may be installed on the same side of the entry point 300 as the entry point sensor 100. For example, the second component 330 may be installed on the door frame 310 on the same of the entry point 300 as the entry point sensor 300, which may be installed on the interior of the door 320.

Figure 5:
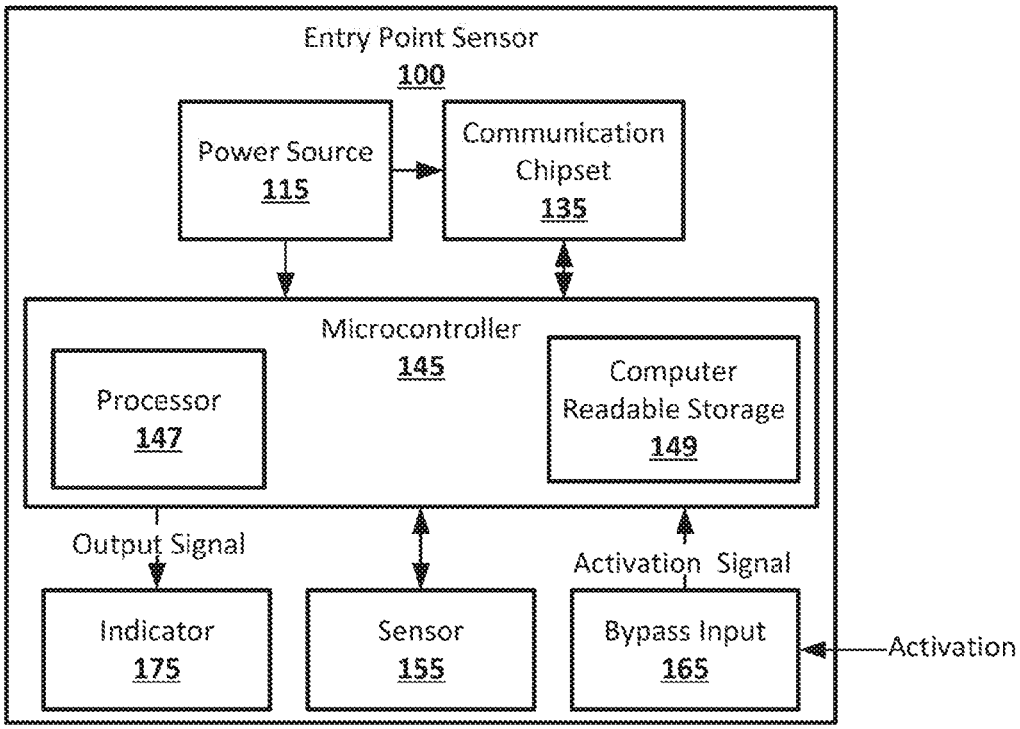
FIG. 5 shows an example arrangement suitable for sensor bypass according to an implementation of the disclosed subject matter.

FIG. 5 shows an example arrangement suitable for sensor bypass according to an implementation of the disclosed subject matter. The bypass input 165 may be activated, with any suitable form of activation, by a person who has access to the bypass input 165 on the entry point sensor 100. For example, the bypass input 165 may be a button which may be activated through depression of the button, a switch activated through adjustment of the position of the switch, or a touchscreen or touchpad activated through a touch or swipe gesture.

Upon being activated, the bypass input 165 may send an activation signal to the microcontroller 145. The activation signal may indicate to the microcontroller 145, and processor 147, that the bypass input 165 was activated. The processor 147 may determine whether the entry point sensor 100 should enter or exit bypass mode, or remain out of bypass mode. For example, if the entry point sensor 100 is not in bypass mode, upon receiving the activation signal from the bypass input 165, the processor 147 may determine whether to cause the entry point sensor 100 to enter bypass mode based on the mode 241 of the security system as received from the hub computing device 200. The processor 147 may determine that the entry point sensor 100 should enter bypass mode when the mode 241 indicates that the security system is in a mode where occupants are expected to be within the environment and the sensors in the environment, including the entry point sensor 100, are armed, and the entry point is not already opened far enough that a person on the other side of the entry point from the entry point sensor 100 could access the bypass input 165, as determined from data gathered by the sensor 155.

The processor 147 may determine that the entry point sensor 100 should not enter bypass mode when the mode 241 indicates that the security system is in a mode where either occupants are not expected to be within the environment and the entry point sensor 100 is armed, or the entry point sensor 100 is not armed, or the entry point is opened far enough that a person on the other side of the entry point from the entry point sensor 100 could access the bypass input 165, as determined from data gathered by the sensor 155. For example, when the entry point sensor 100 is disarmed, there may be no need to enter bypass mode to open the entry point without generating an alarm. When the entry point sensor 100 is armed, but the security system is in a mode in which no occupants are expected to be in the environment, the entry point sensor 100 may not enter bypass mode as there may not supposed to be anyone with access to the bypass input 165, and the activation of the bypass input 165 may be an indication of intrusion that may be reported to the hub computing device 200. When the entry point is already opened and the entry point sensor 100 is not in bypass mode, the entry point sensor 100 may report any activation of the bypass input 165 to the hub computing device 200, as the activation may be an indication of an attempted intrusion. If the entry point sensor 100 is already in bypass mode, the processor 147 may determine that the entry point sensor 100 should exit bypass mode and enter an armed mode when the activation signal is received from the bypass input 165. The entry point sensor 100 may, through the communications chipset 135, notify the hub computing device 200 when the entry point sensor 100 enters or exits bypass mode. The hub computing device 200 may arm or disarm other sensors in the environment based on whether the entry point sensor 100 is entering or exiting bypass mode, for example, disarming nearby motion sensors when the entry point sensor 200 enters bypass mode to prevent the motion of the person who activated the bypass input 165 from generating an alarm. For example, a motion sensor on the other side of an entry point monitored by the entry point sensor 100 may be disarmed by the hub computing device 200 when the entry point sensor 100 enters bypass mode, and may be rearmed when the entry point sensor 100 exits bypass mode.

The processor 147 of the microcontroller 145 may also determine that the entry point sensor 100 should exit bypass mode based on timeout periods or a detected closing of the entry point. For example, after the bypass input 165 is activated and the processor 147 causes the entry point sensor 100 to enter bypass mode, the processor 147 may track a first timeout period. If the entry point sensor 100 does not detect, based on data gathered by the sensor 155, that the entry point has been opened before the first timeout period elapses, or the bypass input 165 is activated again, the processor 147 may cause the entry point sensor 100 to exit bypass mode. If the entry point sensor 100 does detect, based on data gathered by the sensor 155, that the entry point has been opened before the first timeout period elapses, the processor 147 may track a second timeout period. The processor 147 may cause the entry point sensor 100 to exit bypass mode on detecting that the bypass input 165 has been activated or the entry point has been closed before the second timeout period elapses, or on the elapsing of the second timeout period.

The microcontroller 145 may send an output signal to the indicator 175. The output signal may indicate the type of output the indicator 175 should emit, based on whether the entry point sensor 100 in bypass or armed mode, or is entering or exiting bypass mode. For example, when the activation of the bypass input 165 results in the processor 147 causing the entry point sensor 100 to enter bypass mode, the output signal may cause the indicator 175 to emit output that may indicate to a person in proximity to the entry point sensor 100 that the entry point sensor 100 is in bypass mode. For example, the indicator 175 may be an LED, and the output signal may cause the LED to display, or blink at a specified rate, a first color when the entry point sensor 100 is in an armed mode, a second color when the entry point sensor 100 is in a disarmed mode, a third color when the entry point is in a bypass mode, and may display, or blink, a specified color for a specified period of time when the entry point sensor 100 changes between modes.

Figure 6:
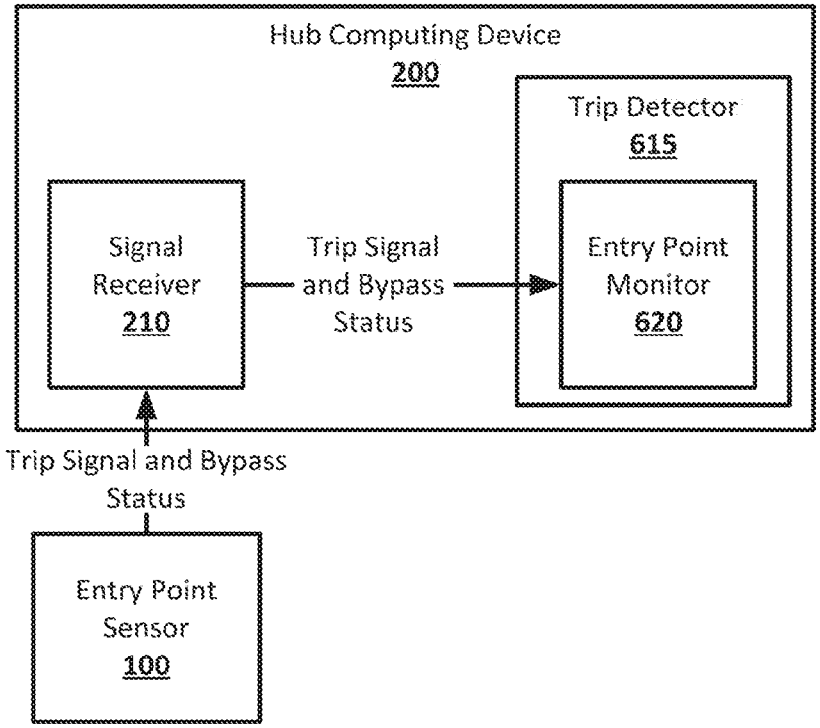
FIG. 6 shows an example arrangement suitable for sensor bypass according to an implementation of the disclosed subject matter.

FIG. 6 shows an example arrangement suitable for sensor bypass according to an implementation of the disclosed subject matter. The entry point sensor 100 may enter bypass mode, for example, based on activation of the bypass input 165. The entry point sensor 100 may detect, based on data gathered by the sensor 155, that the entry point monitored by the entry point sensor 100 is being opened. This entry point sensor 100 may send a signal indicating the open status of the entry point, or trip signal, and the bypass status of the entry point sensor 100, to the hub computing device 200. For example, the signal receiver 210 may receive the trip signal and bypass status of the entry point sensor 100 from the entry point sensor 100.

The hub computing device 200 may include a trip detector 615. The trip detector 615 may be any suitable combination of hardware or software for detecting and handling trip signals issued by sensors that may be part of the security system and may be connected to the hub computing device 200. The trip detector 615 may handle a detected trip signal by, for example, issuing a notification or alert to an appropriate party, such as a resident or occupant of the environment that the particular entry point is open, or sounding a general alert or alarm. The trip detector 615 may include an entry point monitor 620. The entry point monitor 620 may be any suitable combination of hardware and software for determining when a trip signal from an entry point sensor such as the entry point sensor 100 indicates that the entry point has been opened. The entry point monitor 620 may, for example, use data included in the trip signal to determine if the trip signal was caused by an attempted opening of or disturbance of the entry point, or, for example, was due to vibrations caused by passing traffic or from natural sources. When the entry point monitor 620 determines that an entry point is being opened or that entry point sensor 100 is being tampered with, the entry point monitor 620 may generate any suitable signal indicating that the entry point sensor 100 has been tripped. The signal may include an identity of the entry point sensor 100 or entry point at which the trip occurred, and may be sent to any suitable component of the hub computing device 200, which may then take any suitable action. For example, the hub computing device 200 may sound an alarm, notify a user of the hub computing device 200 or another appropriate party, or may take no action depending, for example, on a current security setting of the smart home environment.

The trip detector 615, and entry point monitor 620, may receive the trip signal and bypass status. For example, the signal receiver 210 may direct the trip signal and bypass status from the entry point sensor 100 to the entry point monitor 620. The entry point monitor 620 may determine, based on the trip signal and bypass status and the mode 241 of the security system whether to generate an alarm based on the trip signal indicating that the entry point monitored by the entry point sensor 100 has been opened or disturbed. For example, if the bypass status indicates that the entry point 100 was in bypass mode when the opening of the entry point that resulted in the sending of the trip signal was detected, the entry point monitor 620 may determine that no alarm needs to be generated. The entry point monitor 620 may store a record of the trip signal in the storage 240 of the hub computing device 200, but may take no further action. In some implementations, the entry point monitor 620 may generate a signal indicating that the hub computing device should temporarily disarm other sensors in proximity to the entry point sensor 100. If the bypass status indicates that the entry point sensor 200 is not in bypass mode, the entry point monitor 620 may generate an alarm if the security system, and the entry point sensor 100, are in an armed mode. The entry point monitor 620 may determine whether the entry point sensor 100 is armed based on, for example, the mode 241, and either an indication from the bypass status that the entry point sensor 100 is not in bypass mode or the absence of a bypass status accompanying the trip signal.

Figure 7:
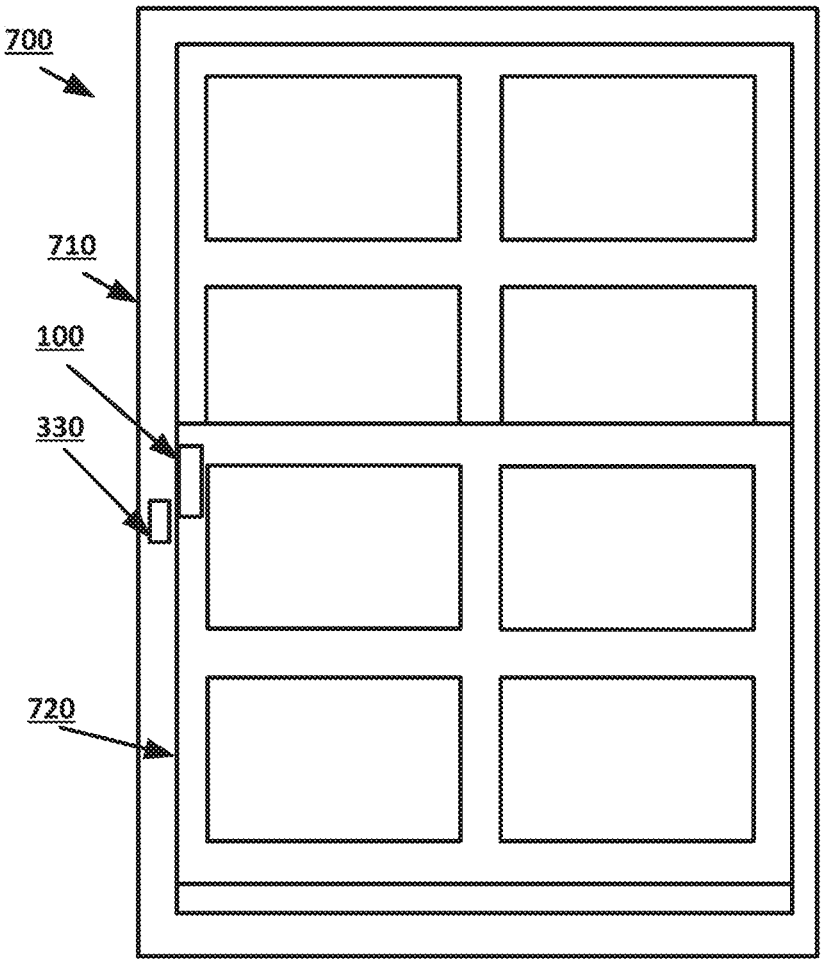
FIG. 7 shows an example of an open entry point suitable for sensor bypass according to an implementation of the disclosed subject matter FIG. 8 show an example of a state diagram suitable for sensor bypass according to an implementation of the disclosed subject matter

FIG. 7 shows an example of an open entry point suitable for sensor bypass according to an implementation of the disclosed subject matter. The entry point sensor 100, with second component 330, may be installed on an entry point 700, which may include a window frame 710 and a window 720. The entry point sensor 100 may be armed, based on the mode 241 of the security system. The bypass input 165 may be activated, and the processor 147 may cause the entry point sensor 100 to enter bypass mode. While the entry point sensor 100 is in bypass mode, the entry point 700 may be opened slightly, for example, with the window 720 being lifted a short distance in the window frame 710. The entry point sensor 100 may detect the opening of the entry point 700, and may send a trip signal and bypass status indicating that the entry point sensor 100 is in bypass mode to the hub computing device 200. The signal receiver 210 may receive the trip signal and bypass status, and direct the trip signal and bypass status to the entry point monitor 620 of the trip detector 615. The entry point monitor 620 may determine that no action needs to be taken based on the trip signal due to the entry point monitor 100 being in bypass mode, as indicated by the bypass status. No alarm may be generated by the trip detector 615.

The entry point sensor 100 may exit bypass mode and enter an armed mode, for example, after a timeout period elapses, or on a subsequent activation of the bypass input 165. The entry point sensor 100 may exit bypass mode while the entry point 700 is still slightly open. Subsequent activation of the bypass input 165 may not cause the entry point sensor 100 to enter bypass mode again for as long as the entry point sensor 100 detects that the entry point 700 is still open. Such subsequent activations of the bypass input 165 may be reported to the hub computing device 200 as indication of an intrusion. The entry point sensor 100 may generate a trip signal if the entry point 700 is detected as being opened further, for example, if someone lifts the window 720 higher into the window frame 710. The trip signal may be sent to the hub computing device 200 with a bypass status indicating that the entry point sensor 100 is not in bypass mode, or with no bypass status. The entry point monitor 620 may receive the trip signal and bypass status, or absence of bypass status, and may generate an alarm. This may allow for bypass mode to be used to slightly open an entry point, such as a door or window, without generating alarm, and to leave the entry point open while still protecting the entry point with the entry point sensor 100.

Figure 8:
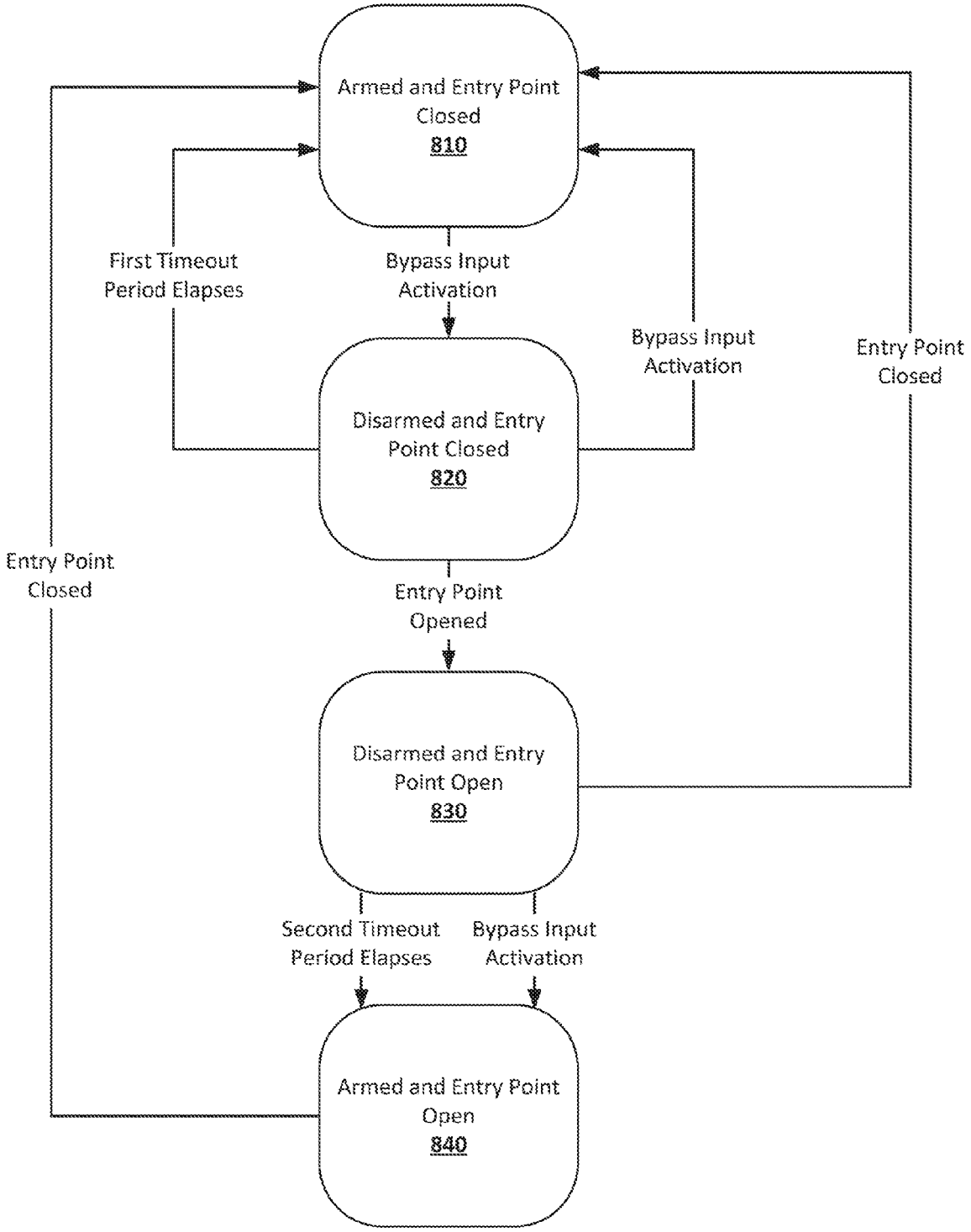

FIG. 8 show an example of a state diagram suitable for sensor bypass according to an implementation of the disclosed subject matter. In state 810, the entry point sensor 100 may be armed and the entry point may be closed. For example, the entry point sensor 100 may not be in bypass mode, and the mode 241 of the security system may indicate that the security system is in an armed mode in which the entry point sensor 100 is armed. While in the state 810, the entry point sensor 100 may receive activation of the bypass input 165. The state may transition to state 820, unless the security system is in a mode where no occupants are expected to be in the environment.

In the state 820, the entry point sensor 100 may be disarmed and the entry point may be closed. For example, the entry point sensor 100 may have entered bypass mode after receiving activation of the bypass input 165. While in the state 820, activation of the bypass input 165 or the elapsing of a first timeout period may result in the state transitioning back to the state 810, as the entry point sensor 100 may exit bypass mode and rearm. The entry point sensor 100 detecting the opening of the entry point may result in the state transitioning to state 830.

In the state 830, the entry point sensor 100 may be disarmed and the entry point may be open. For example, the entry point sensor 100 may be in bypass mode, and the entry point may have been opened. The entry point sensor 100 may send a trip signal and bypass status indicating the entry point sensor 100 is in bypass mode to the hub computing device 200, which may not generate an alarm, and may change the mode, for example, disarm, other sensors in proximity to the entry point sensor 100. While in the state 830, activation of the bypass input 165 or the elapsing of a second timeout period may result in the state transitioning to state 840 as the entry point sensor 100 may exit bypass mode and rearm while the entry point remains open. Closing of the entry point may result in the state transitioning back to the state 810, as the entry point sensor 100 may exit bypass mode and rearm upon detecting that the entry point has been closed.

In the state 840, the entry point sensor 100 may be armed and the entry point may be open. For example, the entry point 100 may have exited bypass mode due to activation of the bypass input 165 or expiration of the second timeout period while the entry point 100 was still open. The entry point sensor 100 may not send a trip signal to the hub computing device 200 despite the entry point being open. If the entry point sensor 100 detects the entry point being opened further, the entry point sensor 100 may send a trip signal to the hub computing device 200 with a bypass status indicating that entry point sensor 100 is not in bypass mode, resulting in the generation of an alarm. Activation of the bypass input 165 may also be reported to the hub computing device 200 as an indication of intrusion. While in the state 840, closing of the entry point may result in the state transitioning back to the state 810, as the entry point sensor 100 may reaming armed upon detecting that the entry point has been closed.

Figure 9:
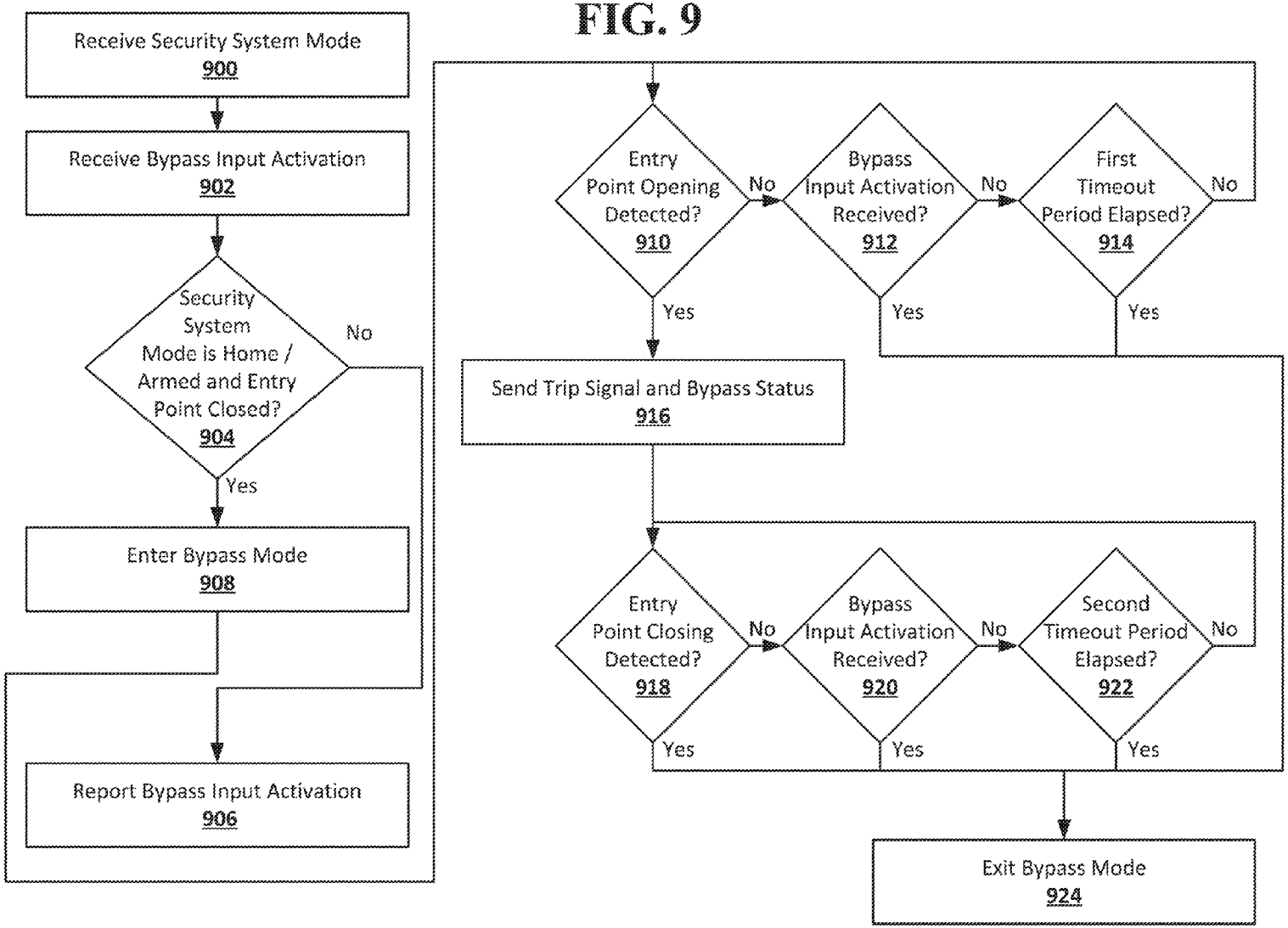
FIG. 9 shows an example of a process suitable for sensor bypass according to an implementation of the disclosed subject matter.

FIG. 9 shows an example of a process suitable for sensor bypass according to an implementation of the disclosed subject matter. At 900, the security system mode may be received. For example, the entry point sensor 100 may receive the mode 241 of the security system from the hub computing device 200. The entry point sensor 100 may receive the mode 241 at any suitable time, such as, for example, whenever the mode 241 is changed, or at other specified times or intervals.

At 902, bypass input activation may be received. For example, the entry point sensor 100 may receive activation of the bypass input 165. A person may provide the activation, for example, pressing a button for the bypass input 165 that is located on the entry point sensor 100. The bypass input 165 may only be accessible to a person on a particular side of the entry point monitored by the entry point sensor 100. For example, the bypass input 165 may only be accessible to a person on the inside of an exterior door.

At 904, whether the security system mode is home/armed and the entry point is closed may be determined. For example, the entry point sensor 100 may check the mode 241 received from the hub computing device 200 to determine whether the current mode of the security system is home/armed, which may be a mode where occupants are expected to be in the environment and where the security system and its sensors, including the entry point sensor 100, are armed. The entry point sensor 100 may ensure that an armed mode indicated by the mode 241 includes arming of the entry point sensor 100. The entry point sensor 100 may also determine whether the entry point monitored by the entry point sensor 100 is closed, for example, using data gathered by the sensor 155. If both the security system is in home/armed mode, including the entry point sensor 100 being armed, and entry point is closed, flow may proceed to 908. Otherwise, flow may proceed to 906.

At 906, the bypass input activation may be reported. For example, the entry point sensor 100 may not be armed, the entry point may not be closed, or the security system may be in an away mode in which no occupants are expected to be in the environment. Activation of the bypass input 165 may not result in the entry point sensor 100 entering bypass mode, and may instead be reported to the hub computing device 200. Activation of the bypass input 165 when the security system is in an away mode or when the entry point is open and the entry point sensor 100 is armed may be an indication of intrusion. Activation of the bypass input 165 when the entry point sensor 100 is not armed, for example, due to the security system being in a disarmed mode, may have no effect on the status of the entry point sensor 100 as there may be no need for the entry point sensor 100 to enter bypass mode.

At 908, bypass mode may be entered. For example, the entry point sensor 100 may enter bypass mode based on the activation of the bypass input 165. Bypass mode may result in trip signals from the entry point sensor 100 not resulting in the generation of an alarm by the hub computing device 200. The indicator 175 may indicate the entry point sensor 100 is in bypass mode, for example, displaying a specified color.

At 910, whether an opening of the entry point has been detected may be determined. For example, the entry point sensor 100 may detect the opening of the entry point monitored by the entry point sensor 100 based on data gathered by the sensor 155. If opening of the entry point is detected, flow may proceed to 916. Otherwise, flow may proceed to 912.

At 912, whether bypass input activation has been received may be determined. For example, the entry point sensor 100 may determine whether the bypass input 165 has been activated again, subsequent to the activation that resulted in the entry point sensor 100 entering bypass mode. If the bypass input activation is received, flow may proceed to 924, where bypass mode may be exited. Otherwise, flow may proceed to 914.

At 914, whether a first timeout period has elapsed may be determined. For example, the entry point sensor 100 may determine whether a specified period of time has elapsed since the entry point sensor 100 entered bypass mode. The first timeout period may be any suitable length of time, such as, for example, 30 seconds. If the first timeout period has elapsed, flow may proceed to 924, where bypass mode may be exited. Otherwise, flow may proceed back to 910.

At 916, a trip signal and bypass status may be sent. For example, the entry point sensor 100, upon detecting that the entry point has been opened, may send a trip signal and bypass status to the hub computing device 200. The trip signal may indicate that the entry point has been opened, and may include any suitable data about the opening of the entry point. The bypass status may indicate that the entry point sensor 100 is in bypass mode, which may result in the hub computing device 200 not generating an alarm based on the trip signal. The hub computing device 200 may disarm other sensors in proximity to the entry point sensor 100.

At 918, whether a closing of the entry point has been detected may be determined. For example, the entry point sensor 100 may detect the closing of the entry point monitored by the entry point sensor 100 based on data gathered by the sensor 155. If closing of the entry point is detected, flow may proceed to 924, where bypass mode may be exited. Otherwise, flow may proceed to 920.

At 920, whether bypass input activation has been received may be determined. For example, the entry point sensor 100 may determine whether the bypass input 165 has been activated again, subsequent to the activation that resulted in the entry point sensor 100 entering bypass mode and to the opening of the entry point. If the bypass input activation is received, flow may proceed to 924, where bypass mode may be exited. Otherwise, flow may proceed to 922.

At 922, whether a second timeout period has elapsed may be determined. For example, the entry point sensor 100 may determine whether a specified period of time has elapsed since the entry point was opened after the entry point sensor 100 entered bypass mode. The second timeout period may be any suitable length of time, such as, for example, 180 seconds. If the second timeout period has elapsed, flow may proceed to 924, where bypass mode may be exited. Otherwise, flow may proceed back to 918.

At 924, bypass mode may be exited. For example, the entry point sensor 100 may exit bypass mode, and may return to an armed mode. The hub computing device 200 may receive an indication that the entry point sensor 100 has exited bypass mode, and may rearm and sensors in proximity to the entry point sensor 100 that were disarmed. The indicator 175 may indicate that the entry point sensor 100 is exiting bypass mode, for example, blinking an LED rapidly in a specified color. The entry point may be closed or open. If the entry point is open, the entry point sensor 100 may not reenter bypass mode until the entry point has been closed, may generate a trip signal if the entry point is opened further, and may report any activation of the bypass input 165 to the hub computing device 200 as in indication of intrusion. If the entry point is opened beyond a threshold, for example, wide enough that a person may enter without opening the entry point any further or that the entry point sensor cannot detect if the entry point is opened further, an alarm, or a warning or other non-alarm notification, may be generated when the entry point sensor 100 exits bypass mode.

Figure 10:
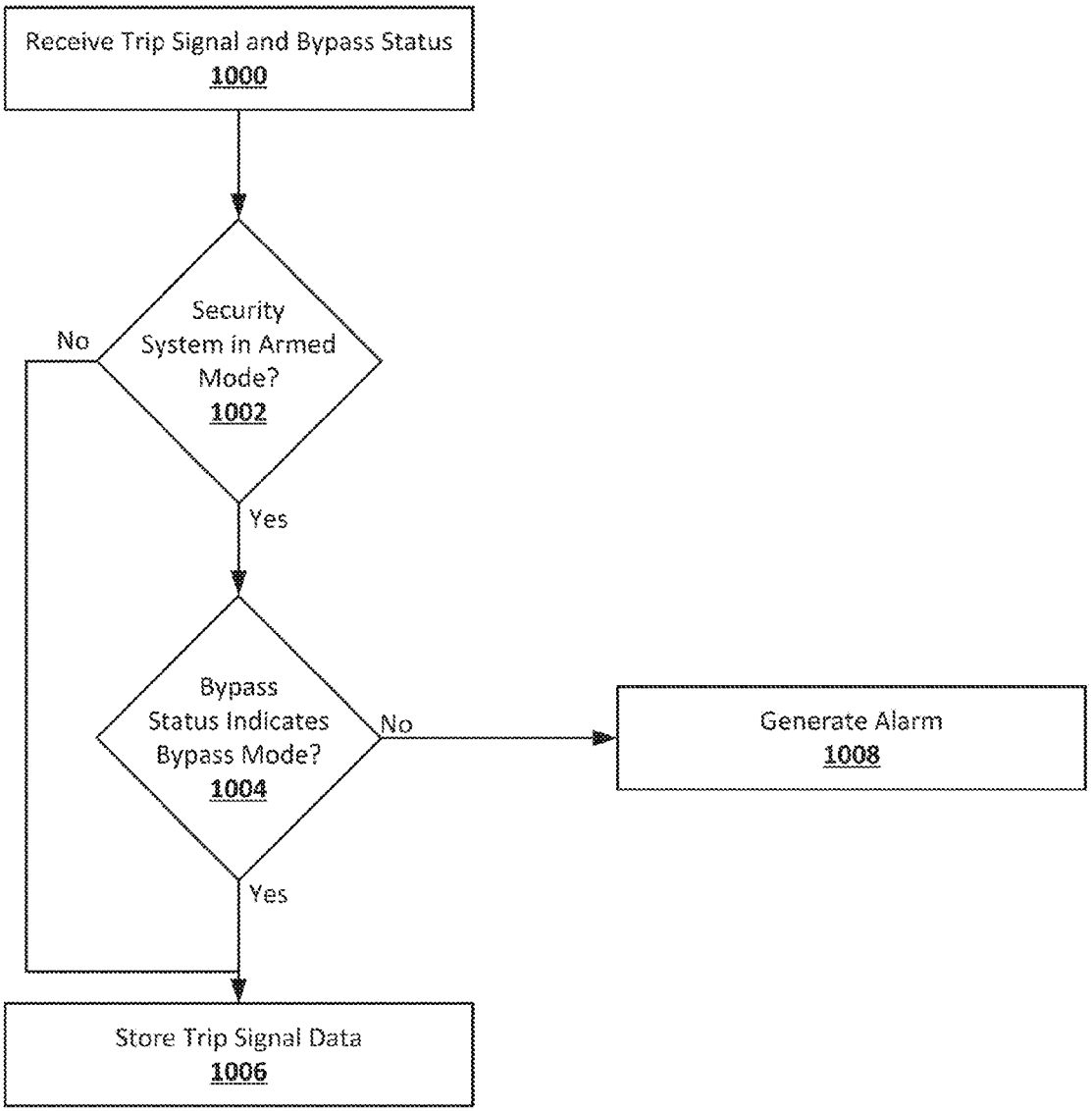
FIG. 10 shows an example of a process suitable for sensor bypass according to an implementation of the disclosed subject matter.

FIG. 10 shows an example of a process suitable for sensor bypass according to an implementation of the disclosed subject matter. At 1000, a trip signal and bypass status may be received. For example, the hub computing device 200 may receive a trip signal and bypass status generated by the entry point sensor 100. The trip signal may indicate the entry point monitored by the entry point sensor 100 has been opened or disturbed, and the bypass status may indicate whether the entry point sensor 100 is in bypass mode.

At 1002, whether the security system is in an armed mode may be determined. For example, the hub computing device 200 may determine, from the mode 241, whether the security system is in an armed mode or a disarmed mode, and whether the entry point sensor 100 from which the trip signal was received is disarmed based on the mode 241 of the security system. If the security system is in a disarmed mode, for example, with no sensors armed, or is in an armed mode in which the entry point sensor 100 is disarmed, flow may proceed to 1008 where data from the trip signal may be stored and no other action may be taken, as the trip signal may have been generated by a disarmed sensor. Otherwise, flow may proceed to 1004.

At 1004, whether the bypass status indicates the entry point sensor is in bypass mode may be determined. For example, the hub computing device 200 may check the bypass status, which may directly indicate whether or not the entry point sensor 100 is in bypass mode. In some implementations, the absence of any bypass status accompanying the trip signal may indicate that the entry point sensor 100 that generated the trip signal is not in bypass mode. If the bypass status indicates that the entry point sensor is in bypass mode, flow may proceed to 1006. Otherwise, flow may proceed to 1008, where an alarm or other appropriate notification may be generated, as an armed entry point sensor that is not in bypass mode may have been tripped by an opening of the entry point being monitored by the entry point sensor.

At 1006, the trip signal data may be stored. For example, the hub computing device 200 may store any suitable data included in the trip signal, such as, for example, the identity of the entry point sensor 100 that generated the trip signal, the time the trip signal was generated, and any raw or processed data from the sensor 155. The hub computing device 200 may not generate an alarm, as the trip signal may have been generated by an entry point sensor in bypass mode.

At 1008, an alarm may be generated. For example, the trip signal may have been generated by an armed entry point sensor not in bypass mode. The hub computing device 200 may generate an alarm or otherwise generate an alert or notification to a user of the security system or other appropriate party, such as a security service, indicating that the entry point is open.

Implementations disclosed herein may use one or more sensors. In general, a "sensor" may refer to any device that can obtain information about its environment. Sensors may be described in terms of the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an away (e.g., "armed") state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor, a sensor device, or a sensor package. For clarity, sensors are described with respect to the particular functions they perform and/or the particular physical hardware used, when such specification is necessary for understanding of the embodiments disclosed herein.

Figure 11:
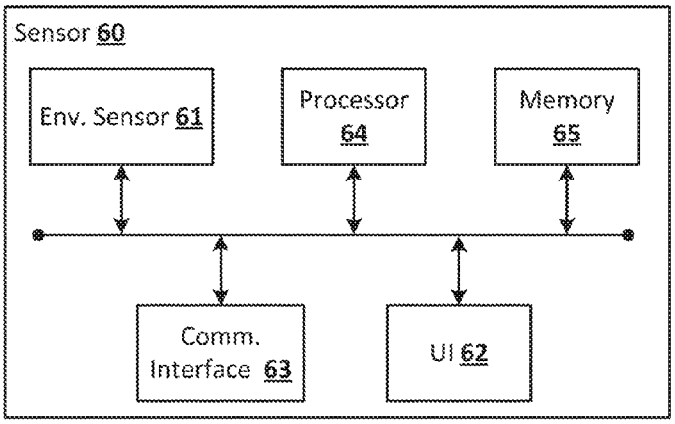
FIG. 11 shows an example sensor as disclosed herein.

A sensor may include hardware in addition to the specific physical sensor that obtains information about the environment. FIG. 11 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a liquid crystal display (LCD), light-emitting diode (LED) display, or limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

In some configurations, two or more sensors may generate data that can be used by a processor of a system to generate a response and/or infer a state of the environment. For example, an ambient light sensor in a room may determine that the room is dark (e.g., less than 60 lux). A microphone in the room may detect a sound above a set threshold, such as 60 dB. The system processor may determine, based on the data generated by both sensors that it should activate one or more lights in the room. In the event the processor only received data from the ambient light sensor, the system may not have any basis to alter the state of the lighting in the room. Similarly, if the processor only received data from the microphone, the system may lack sufficient data to determine whether activating the lights in the room is necessary, for example, during the day the room may already be bright or during the night the lights may already be on. As another example, two or more sensors may communicate with one another. Thus, data generated by multiple sensors simultaneously or nearly simultaneously may be used to determine a state of an environment and, based on the determined state, generate a response.

Data generated by one or more sensors may indicate a behavior pattern of one or more users and/or an environment state over time, and thus may be used to "learn" such characteristics. For example, data generated by an ambient light sensor in a room of a house and the time of day may be stored in a local or remote storage medium with the permission of an end user. A processor in communication with the storage medium may compute a behavior based on the data generated by the light sensor. The light sensor data may indicate that the amount of light detected increases until an approximate time or time period, such as 3:30 PM, and then declines until another approximate time or time period, such as 5:30 PM, at which point there is an abrupt increase in the amount of light detected. In many cases, the amount of light detected after the second time period may be either below a dark level of light (e.g., under or equal to 60 lux) or bright (e.g., equal to or above 400 lux). In this example, the data may indicate that after 5:30 PM, an occupant is turning on/off a light as the occupant of the room in which the sensor is located enters/leaves the room. At other times, the light sensor data may indicate that no lights are turned on/off in the room. The system, therefore, may learn that occupants patterns of turning on and off lights, and may generate a response to the learned behavior. For example, at 5:30 PM, a smart home environment or other sensor network may automatically activate the lights in the room if it detects an occupant in proximity to the home. In some embodiments, such behavior patterns may be verified using other sensors. Continuing the example, user behavior regarding specific lights may be verified and/or further refined based upon states of, or data gathered by, smart switches, outlets, lamps, and the like.

Sensors as disclosed herein may operate within a communication network, such as a conventional wireless network, a mesh network (e.g., Thread), and/or a sensor-specific network through which sensors may communicate with one another and/or with dedicated other devices. In some configurations, one or more sensors may provide information to one or more other sensors, to a central controller, or to any other device capable of communicating on a network with the one or more sensors. A central controller may be general- or special-purpose. For example, one type of central controller is a home automation network, that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 12:
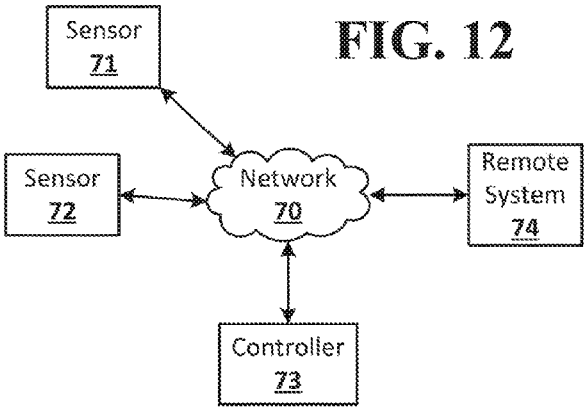
FIG. 12 shows an example of a sensor network as disclosed herein.

FIG. 12 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer such as a smartphone, a smartwatch, a tablet, a laptop, etc. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. In some configurations, the system may have multiple controllers 74 such as where multiple occupants' smartphones and/or smartwatches are authorized to control and/or send/receive data to or from the various sensors 71, 72 deployed in the home. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

The sensor network shown in FIG. 12 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 12 may include a plurality of devices, including intelligent, multi-sensing, network-connected devices, that can integrate seamlessly with each other and/or with a central server or a cloud-computing system (e.g., controller 73 and/or remote system 74) to provide home-security and smart-home features. The controller may determine an intensity level of illumination for lights connected to the smart home system and/or a color or temperature for the lights. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 12.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 12, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 12, and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 12 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 12. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjust the power and/or speed of the fan, accordingly. Smart wall plugs may control supply of power to one or more wall plugs (e.g., such that power is not supplied to the plug if nobody is detected to be within the smart-home environment). For example, one of the smart wall plugs may control supply of power to a lamp (not shown).

In embodiments of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 12. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not be placed in an away mode (e.g., "armed") unless all smart entry detectors (e.g., sensors 71, 72) indicate that all doors, windows, entryways, and the like are closed and/or that all smart entry detectors are in an away mode. In some configurations, the system may arm if it can be determined that the distance the door (or window) is ajar is insubstantial (e.g., the opening is not wide enough for a person to fit through).

The smart-home environment of the sensor network shown in FIG. 12 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 12) can be communicatively coupled to each other via the network 70, and to the controller 73 and/or remote system 74 to provide security, safety, and/or comfort for the smart home environment.

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, or the like). A webpage or application can be configured to receive communications from the user and control the one or more of the network-connected smart devices based on the communications and/or to present information about the device's operation to the user. For example, the user can view or change the mode of the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some embodiments including sensors used by or within the smart-home environment. Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event that any of the network-connected smart devices, such as smart wall plugs located outdoors, detect movement at nighttime, the controller 73 and/or remote system 74 can activate the outdoor lighting system and/or other lights in the smart-home environment.

Figure 13:
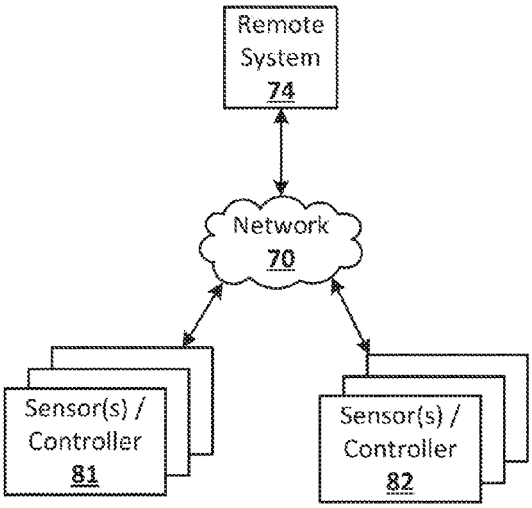
FIG. 13 shows an example configuration of sensors, one or more controllers, and a remote system as disclosed herein.

In some configurations, a remote system 74 may aggregate data from multiple locations, such as multiple buildings, multi-resident buildings, and individual residences within a neighborhood, multiple neighborhoods, and the like. In general, multiple sensor/controller systems 81, 82 as previously described with respect to FIG. 12 may provide information to the remote system 74 as shown in FIG. 13. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. As another example, systems disclosed herein may allow a user to restrict the information collected by the systems disclosed herein to applications specific to the user, such as by disabling or limiting the extent to which such information is aggregated or used in analysis with other information from other users. Thus, the user may have control over how information is collected about the user and used by a system as disclosed herein.

Figure 14:
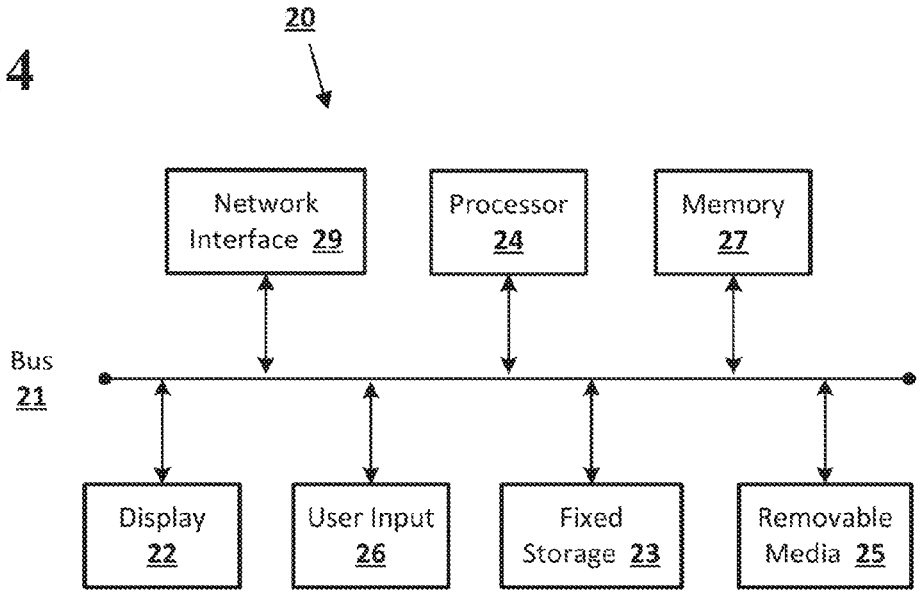
FIG. 14 shows a computer according to an embodiment of the disclosed subject matter.

Implementations of the presently disclosed subject matter may be implemented in and used with a variety of component and network architectures. FIG. 14 is an example computer 20 suitable for implementations of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display screen via a display adapter, a user input interface 26, which may include one or more controllers and associated user input devices such as a keyboard, mouse, and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components. Applications resident with the computer 20 are generally stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection, or the like. For example, the network interface 29 may allow the computer to communicate with other computers via one or more local, wide-area, or other networks, as shown in FIG. 15.

Many other devices or components (not shown) may be connected in a similar manner (e.g., document scanners, digital cameras, and so on). Conversely, all of the components shown in FIG. 14 need not be present to practice the present disclosure. The components can be interconnected in different ways from that shown. The operation of a computer such as that shown in FIG. 14 is readily known in the art and is not discussed in detail in this application. Code to implement the present disclosure can be stored in computer-readable storage media such as one or more of the memory 27, fixed storage 23, removable media 25, or on a remote storage location.

Figure 15:
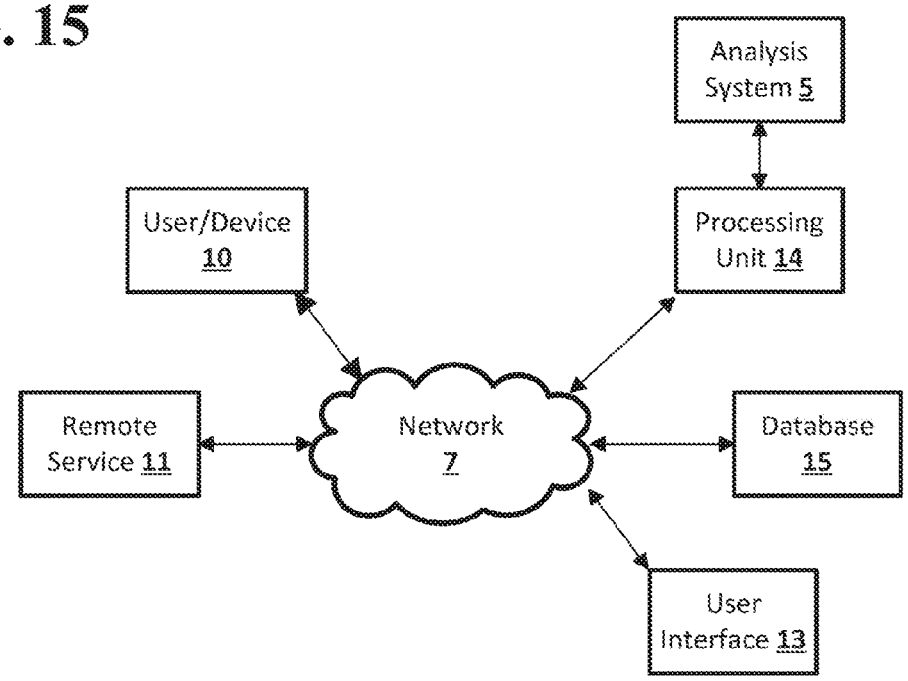
FIG. 15 shows a network configuration according to an embodiment of the disclosed subject matter.

FIG. 15 shows an example network arrangement according to an implementation of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. The disclosed subject matter also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions.

Implementations may use hardware that includes a processor, such as a general-purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A computer-implemented method performed by a data processing apparatus, the method comprising:

changing a mode of an entry point sensor from an armed mode to a bypass mode upon detection of an activation of a bypass input of the entry point sensor;

determining by the entry point sensor that there has been a change in the position of the entry point while the mode of the entry point sensor is the bypass mode;

in response to the determining that there has been a change in the position of the entry point while the mode of the entry point sensor is the bypass mode, transmitting a trip signal and an indication that the mode of the entry point sensor is the bypass mode to a hub computing device for the security system, wherein the trip signal does not result in the generation of an alarm by the hub computing device due to the indication that the mode of the entry point sensor is the bypass mode; and changing the mode of the entry point sensor from the bypass mode to the armed mode based on, before a determination by the entry point sensor that there has been a second change in the position of the entry point, either a timeout period elapsing or a detection of second activation of the bypass input of the entry point sensor;

determining by the entry point sensor that there has been a second change in the position of the entry point while the mode of the entry point sensor is the armed mode after either a timeout period elapsing or a detection of second activation of the bypass input of the entry point sensor; and in response to determining that there has been a second change in the position of the entry point while the mode of the entry point sensor is the armed mode, transmitting a second trip signal to the hub computing device to the security system, wherein the second trip signal results in a generation of an alarm by the hub computing device.

2. The computer-implemented method of claim 1, further comprising:

after changing the mode of the entry point sensor from the bypass mode to the armed mode based on a timeout period elapsing, or a detection of second activation of the bypass input of the entry point sensor, or a determination by the entry point sensor that there has been a second change in the position of the entry point while the mode of the entry point sensor is the bypass mode, changing the mode of the entry point sensor from the armed mode to the bypass upon detection of a third activation of a bypass input of the entry point sensor.

3. The computer-implemented method of claim 2, further comprising:

changing the mode of the entry point sensor from the bypass mode to the armed mode based on a second timeout period elapsing before a detection of a fourth activation of the bypass input of the entry point sensor and before a determination by the entry point sensor that there has been a third change in the position of the entry point while the mode of the entry point sensor is the bypass mode.

4. The computer-implemented method of claim 2, further comprising:

changing the mode of the entry point sensor from the bypass mode to the armed mode based on a detection of a fourth activation of the bypass input of the entry point sensor before a second timeout period elapses and before a determination by the entry point sensor that there has been a third change in the position of the entry point while the mode of the entry point sensor is the bypass mode.

5. The computer-implemented method of claim 2, further comprising:

changing the mode of the entry point sensor from the bypass mode to the armed mode based on a determination by the entry point sensor that there has been a third change in the position of the entry point and a fourth change in the position of the entry point subsequent to the third change while the mode of the entry point sensor is the bypass mode before the first timeout period elapses and before a detection of a fourth activation of the bypass input of the entry point sensor.

6. The computer-implemented method of claim 2, further comprising:

determining by the entry point sensor that there has been another change in the position of the entry point subsequent to the change in the position of the entry point while the mode of the entry point sensor is the bypass mode; and not transmitting a trip signal to the hub computing device in response to the determining that there has been another change in the position of the entry point.

7. The computer-implemented method of claim 1, wherein the bypass input is a hardware input of the entry point sensor.

8. The computer-implemented method of claim 7, wherein the bypass input is physically accessible only to a person on the same side of the entry point as the entry point sensor when the entry point is closed.

9. The computer-implemented method of claim 1, wherein the entry point sensor outputs an indication when the mode of the entry point sensor is the bypass mode.

10. An entry point sensor apparatus comprising:

a sensor that detects one or more characteristics of an entry point;

a bypass input that receives an activation;

a communications chipset that communicates with a hub computing device of a security system; and a processor that changes a mode of the entry point sensor from an armed mode to a bypass mode upon detection of an activation of a bypass input of the entry point sensor, makes a determination that there has been a change in the position of the entry point while the mode of the entry point sensor is the bypass mode based on the one or more characteristics of the entry point detected by the sensor, in response the determination that there has been a change in the position of the entry point while the mode of the entry point sensor is the bypass mode, transmits, using the communications chipset, a trip signal and an indication that the mode of the entry point sensor is the bypass mode to a hub computing device for the security system, wherein the trip signal does not result in the generation of an alarm by the hub computing device due to the indication that the mode of the entry point sensor is the bypass mode, changes the mode of the entry point sensor from the bypass mode to the armed mode based on, before a determination by the entry point sensor that there has been a second change in the position of the entry point, either a timeout period elapsing or a detection of second activation of the bypass input of the entry point sensor, determines that there has been a second change in the position of the entry point while the mode of the entry point sensor is the armed mode after either a timeout period elapsing or a detection of second activation of the bypass input of the entry point sensor, and in response to a determination that there has been a second change in the position of the entry point while the mode of the entry point sensor is the armed mode, transmits a second trip signal to the hub computing device to the security system, wherein the second trip signal results in a generation of an alarm by the hub computing device.

11. The entry point sensor of claim 10, wherein the processor further determines a mode of the security system and does not change mode of the entry point sensor to the bypass mode upon detection of the activation of the bypass input when the mode of the security system indicates either that the entry point sensor is not in an armed mode or the security system is in an away mode.

12. The entry point sensor of claim 10, wherein the processor further changes the mode of the entry point sensor from the bypass mode to the armed mode upon the elapsing of a first timeout period after the detection of the activation of the bypass input or upon detection of a second activation of the bypass input after the detection of the activation of the bypass input and before the elapsing of the first timeout period.

13. The entry point sensor of claim 10, wherein the processor further makes a determination that the entry point has changed position based on the characteristics of the entry point detected by the sensor after the detection of the activation of the bypass input and before the elapsing of a first timeout period and the detection of a second activation of the bypass input.

14. The entry point sensor of claim 13, wherein the processor further changes the mode of the entry point sensor from the bypass mode to the armed mode based on making a determination that the entry point has changed position a second time after a having made the determination that the entry point has changed position.

15. The entry point sensor of claim 13, wherein the processor further changes the mode of the entry point sensor from the bypass mode to the armed mode based upon the elapsing of a second timeout period before detection of a second activation of the bypass input, and changes the mode of the entry point sensor from the armed mode to the bypass mode upon the detection of the second activation of the bypass input subsequent to the elapsing of the second timeout period and the changing of the mode of the entry point sensor from the bypass mode to the armed mode.

16. A computer-implemented system for sensor bypass comprising:

an entry point sensor comprising a bypass input and a communications chipset that communicates with a hub computing device, that changes a mode of the entry point sensor from an armed mode to a bypass mode upon detection of an activation of a bypass input, determines that there has been a change in the position of the entry point while the mode of the entry point sensor is the bypass mode, in response to the determining that there has been a change in the position of the entry point while the mode of the entry point sensor is the bypass mode, transmits a trip signal and an indication of the mode to a hub computing device for the security system, changes the mode of the entry point sensor from the bypass mode to the armed mode based on, before a determination by the entry point sensor that there has been a second change in the position of the entry point, a timeout period elapsing or a detection of second activation of the bypass input of the entry point sensor determine by the entry point sensor that there has been a second change in the position of the entry point while the mode of the entry point sensor is the armed mode after either a timeout period elapsing or a detection of second activation of the bypass input of the entry point sensor, and in response to a determination that there has been a second change in the position of the entry point while the mode of the entry point sensor is the armed mode, transmit a second trip signal to the hub computing device to the security system; and a hub computing device that receives the trip signal and the indication of the mode from the entry point sensor, and does not generate an alarm when the indication of the mode received with the trip signal indicates that the mode is the bypass mode is, and generates an alarm when the indication of the mode received with the second trip signal indicates that the mode is the armed mode.

17. The computer-implemented system of claim 16, wherein the entry point sensor further generates and sends the trip signal upon detecting that the entry point monitored by the entry point sensor has changed position and sends the indication of the mode in conjunction with sending the trip signal.

18. The computer-implemented system of claim 16, wherein the hub computing device further sends an indication of the mode of a security system to the entry point sensor.

19. The computer-implemented system of claim 16, wherein the hub computing device further changes the mode of one or more sensors of a security system when the indication of the mode indicating received by the hub computing device indicates that the mode is the bypass mode.

20. A system comprising: one or more computers and one or more storage devices storing instructions which are operable, when executed by the one or more computers, to cause the one or more computers to perform operations comprising:

changing a mode of an entry point sensor from an armed mode to a bypass mode upon detection of an activation of a bypass input of the entry point sensor;

determining by the entry point sensor that there has been a change in the position of the entry point while the mode of the entry point sensor is the bypass mode;

in response to the determining that there has been a change in the position of the entry point while the mode of the entry point sensor is the bypass mode, transmitting a trip signal and an indication that the mode of the entry point sensor is the bypass mode to a hub computing device for the security system, wherein the trip signal does not result in the generation of an alarm by the hub computing device due to the indication that the mode of the entry point sensor is the bypass mode; and changing the mode of the entry point sensor from the bypass mode to the armed mode based on, before a determination by the entry point sensor that there has been a second change in the position of the entry point, either a timeout period elapsing or a detection of second activation of the bypass input of the entry point sensor;

determining by the entry point sensor that there has been a second change in the position of the entry point while the mode of the entry point sensor is the armed mode after either a timeout period elapsing or a detection of second activation of the bypass input of the entry point sensor; and in response to determining that there has been a second change in the position of the entry point while the mode of the entry point sensor is the armed mode, transmitting a second trip signal to the hub computing device to the security system, wherein the second trip signal results in a generation of an alarm by the hub computing device.

* * * * *